US007114439B2

(12) United States Patent
Gerner et al.

(10) Patent No.: US 7,114,439 B2
(45) Date of Patent: Oct. 3, 2006

(54) PRINTING GROUPS OF A PRINTING PRESS

(75) Inventors: Erich Max Karl Gerner, Bütthard (DE); Bernd Kurt Masuch, Kürnach (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 14 days.

(21) Appl. No.: 10/485,102

(22) PCT Filed: Jul. 3, 2002

(86) PCT No.: PCT/DE02/02409

§ 371 (c)(1),
(2), (4) Date: Feb. 2, 2004

(87) PCT Pub. No.: WO03/016057

PCT Pub. Date: Feb. 27, 2003

(65) Prior Publication Data

US 2004/0231536 A1 Nov. 25, 2004

(30) Foreign Application Priority Data

| | | |
|---|---|---|
| Aug. 3, 2001 | (DE) | 101 38 221 |
| Nov. 8, 2001 | (DE) | 101 54 837 |
| Dec. 23, 2001 | (DE) | 101 63 961 |
| Dec. 23, 2001 | (DE) | 101 63 962 |
| Dec. 23, 2001 | (DE) | 101 63 963 |
| Apr. 9, 2002 | (DE) | PCT/DE02/01298 |

(51) Int. Cl.
*B41F 7/02* (2006.01)

(52) U.S. Cl. ..... 101/217; 101/181; 101/352.06

(58) Field of Classification Search ..... 101/138, 101/142, 143, 216, 217, 218, 180, 181, 183, 101/219, 220, 350.3, 352.06
See application file for complete search history.

(56) References Cited

U.S. PATENT DOCUMENTS

| | | | | |
|---|---|---|---|---|
| 2,115,734 | A | 5/1938 | Lamatsch | |
| 2,282,655 | A | 5/1942 | Huck | |
| 3,565,006 | A * | 2/1971 | Stewart | 101/248 |
| 4,000,691 | A | 1/1977 | Fischer | |
| 4,088,074 | A | 5/1978 | Dahlgren et al. | |
| 4,125,073 | A | 11/1978 | Bain | |
| 4,424,744 | A | 1/1984 | Harper et al. | |
| 4,598,640 | A | 7/1986 | Nawrath | |
| 4,606,269 | A | 8/1986 | Jeschke et al. | |
| 4,686,901 | A | 8/1987 | Arndt et al. | |
| 4,729,309 | A | 3/1988 | Saterini et al. | |

(Continued)

FOREIGN PATENT DOCUMENTS

| | | |
|---|---|---|
| CH | 345906 | 6/1960 |

(Continued)

*Primary Examiner*—Ren Yan
(74) *Attorney, Agent, or Firm*—Jones, Tullar & Cooper, P.C.

(57) ABSTRACT

A printing group of a printing press is comprised of at least one pair of cylinders which include a form cylinder and a transfer cylinder. The transfer cylinder cooperates with an impression cylinder to apply ink to a web of material, with the web being guided vertically. The circumference of at least one of the transfer cylinders and the impression cylinder is an integral multiple, greater than one of the circumference of the form cylinder. The transfer cylinder and the form cylinder have respective drive motors that are mechanically independent from the drive of the respective other cylinder.

53 Claims, 14 Drawing Sheets

U.S. PATENT DOCUMENTS

| | | | | |
|---|---|---|---|---|
| 5,303,909 | A | 4/1994 | Maylaender | |
| 5,692,439 | A | 12/1997 | Wech | |
| 5,713,281 | A | 2/1998 | Hummel et al. | |
| 5,802,975 | A * | 9/1998 | Prem et al. | 101/375 |
| 5,826,505 | A | 10/1998 | Volz et al. | |
| 5,868,071 | A | 2/1999 | Niemiro et al. | |
| 6,019,039 | A | 2/2000 | Knauer et al. | |
| 6,032,579 | A | 3/2000 | Richards | |
| 6,050,185 | A | 4/2000 | Richards | |
| 6,220,159 | B1 | 4/2001 | Wieland | |
| 6,289,805 | B1 | 9/2001 | Douillard et al. | |
| 6,298,779 | B1 | 10/2001 | Gotanda et al. | |
| 6,334,389 | B1 | 1/2002 | Fischer | |
| 6,338,298 | B1 * | 1/2002 | Schneider et al. | 101/179 |
| 6,374,731 | B1 | 4/2002 | Walczak et al. | |
| 6,397,743 | B1 | 6/2002 | Dauer et al. | |
| 6,408,747 | B1 | 6/2002 | Koppelkamm et al. | |
| 6,408,748 | B1 | 6/2002 | Hajek et al. | |
| 6,474,232 | B1 * | 11/2002 | Weschenfelder | 101/217 |
| 6,494,138 | B1 | 12/2002 | Gottling et al. | |
| 6,644,184 | B1 | 11/2003 | Hajek et al. | |
| 6,920,824 | B1 * | 7/2005 | Holm | 101/217 |
| 2002/0178946 | A1 | 12/2002 | Hahn | |
| 2002/0178947 | A1 | 12/2002 | Hahn | |

FOREIGN PATENT DOCUMENTS

| | | | |
|---|---|---|---|
| DE | 23 09 850 | | 2/1975 |
| DE | 29 32 105 | A1 | 2/1981 |
| DE | 34 12 812 | C1 | 6/1985 |
| DE | 34 09 194 | A1 | 9/1985 |
| DE | 33 27 872 | C2 | 6/1986 |
| DE | 91 09 833.5 | U1 | 10/1991 |
| DE | 42 04 604 | A1 | 8/1993 |
| DE | 36 20 156 | C2 | 12/1993 |
| DE | 44 15 711 | A1 | 11/1995 |
| DE | 44 30 693 | A1 | 3/1996 |
| DE | 195 05 625 | C2 | 12/1996 |
| DE | 196 03 663 | A1 | 8/1997 |
| DE | 196 23 224 | C1 | 9/1997 |
| DE | 198 15 294 | A1 | 10/1998 |
| DE | 198 03 809 | A1 | 8/1999 |
| DE | 197 55 316 | C2 | 10/1999 |
| DE | 199 37 796 | A1 | 2/2001 |
| DE | 199 61 574 | A1 | 7/2001 |
| EP | 0 234 456 | A2 | 9/1987 |
| EP | 0 699 524 | A2 | 3/1996 |
| EP | 0 862 999 | A2 | 9/1998 |
| EP | 0 878 299 | A1 | 11/1998 |
| EP | 0 933 200 | A1 | 1/1999 |
| EP | 1 075 945 | A1 | 2/2001 |
| EP | 1 125 734 | A1 | 8/2001 |
| EP | 1 037 747 | B1 | 11/2001 |
| GB | 2 309 668 | A | 8/1997 |
| JP | 56021860 | A | 2/1981 |
| JP | 57131561 | | 8/1982 |
| JP | 08085196 | A | 2/1996 |
| JP | 100771694 | A | 3/1998 |
| JP | 2000-141613 | | 5/2000 |
| WO | WO 99/08873 | | 2/1999 |

* cited by examiner

PRINTING GROUPS OF A PRINTING PRESS

FIELD OF THE INVENTION

The present invention is directed to printing groups of a printing press. Each printing group includes at least a forme cylinder and a transfer cylinder. The transfer cylinder cooperates with a third cylinder to print a web.

BACKGROUND OF THE INVENTION

A printing group is known from DE 198 03 809 A1, whose forme cylinder has one printing plate in the circumferential direction and several printing plates in the linear direction on its circumference. A transfer cylinder, working together with the forme cylinder, has a double circumference and is embodied with one printing blanket in the circumferential direction, and in the linear direction with two printing blankets which, however are arranged offset with respect to each other in the circumferential direction.

A printing group with a forme cylinder, a transfer cylinder and a counter-pressure cylinder is known from JP 56-021860 A. Each cylinder is driven by its own drive motor.

DE 196 03 663 A1 shows a bridge printing group with respective cylinders which are each driven by their own drive motor. The forme cylinders are each driven via a drive pinion assigned to the drive motor. The transfer cylinders are each driven via coaxially arranged stators and cylinder journals which are embodied as rotors.

Individually driven forme, transfer and counter-pressure cylinders, each with its own drive motor, are disclosed in EP 0 699 524 A2. Extensions of the cylinder journals, which are each embodied in the form of a rotor, work together with stators.

The drive mechanism for a cylinder pair is disclosed in DE 34 09 194 A1. A spur-toothed pinion of a drive motor acts on a spur-toothed gear wheel of a transfer cylinder, from which gear wheel power is transferred to a forme cylinder via a helical gear.

The drive mechanism of a printing group is known from DE 197 55 316 C2. Two cooperating cylinders each have a drive motor and a gear arranged between the drive motor and the respective cylinder.

EP 1 037 747 B1 discloses a printing group with cylinders of equal size. Each cylinder has its own drive motor, which is fixed in place on a frame. For example, the rotors of these drive motors are connected either directly, i.e. without a gear, or indirectly, via a gear, such as, for example, an integrated planetary gear, with the journals of the cylinders. A compensating coupling is arranged between the drive motors and the assigned journals of the cylinders. A double-jointed coupling is arranged, fixed against relative rotation, between the journals of the movable rubber blanket cylinders and the respectively assigned drive motor.

A drive mechanism for a printing group is known from U.S. Pat. No. 6,298,779 B1. For the purpose of rotatory driving, a first drive motor drives several distributing cylinders of an inking unit via one gear, and a second drive motor drives a dampening cylinder via another gear. The gears are arranged between two frame walls.

DE 44 30 693 A1 discloses a printing group with an inking and a dampening unit. Distributing cylinders of the inking cylinder can each be axially driven either by its own drive motor or, in a preferred embodiment, together via a gear wheel connection by one drive motor. An axial lift or movement can be generated at each distribution cylinder by the use of a linear motor.

SUMMARY OF THE INVENTION

The object of the present invention is directed to providing printing groups of a printing press.

In accordance with the present invention, this object is attained by providing the printing group of the printing press with at least one pair of cylinders which consist of forme cylinder and of a transfer cylinder. The transfer cylinder cooperates with an impression or counter-pressure cylinder and applies ink to a web which passes between the transfer cylinder and the impression cylinder. The circumference of the transfer cylinder and/or of the impression cylinder is a whole number multiple, greater than one of the circumference of the forme cylinder. An inking unit may be assigned to the forme cylinders. Various arrangements of drive motor for the cylinders and the inking unit are provided.

The advantages to be gained by the present invention lie, in particular, in that the provision of the transfer cylinder with a circumference which is greater by a whole number multiple in comparison with the circumference of the forme cylinder, makes possible a high degree of rigidity and, connected with that, an effective support of the forme cylinder working together with the transfer cylinder. In spite of the transfer cylinder performing the relatively large actuation movement required for disengagement from printing during a flying printing plate change, its seating, inclusive of its journal, can be stably dimensioned to be particularly large. On the other hand, the small diameter of the forme cylinder affords a larger operating space between two double printing groups, which are embodied in accordance with the invention, because of which the printing groups can be better shielded against noise. This also increases the accessibility for mounting a device for the automatic changing of the printing formes, or a device for washing the rubber blanket.

With the arrangement of several rubber blankets on the transfer cylinder in the linear direction of the transfer cylinder, the slits or grooves used for fastening the ends of the rubber blankets to the cylinder can be arranged offset, in respect to each other, in the circumferential direction of the transfer cylinder, with two such rubber blankets preferably being offset by 180°.

With a view toward flexibility of operation and toward an interruption-free operation, it is advantageous to equip the printing group cylinders, at least in pairs, with their own drive motor.

The use of drive motors at each one of the printing group cylinders moreover increases the flexibility of each printing group, and uncouples the cylinders on the driven side.

The arrangement and the size of gears between all of the cylinders and the drive motors is particularly advantageous for maintaining the optimal rpm range of the drive motors. In particular, in connection with changing different operating requirements, such as occur, for example, during set-up and during renewed acceleration, as well as with steady state operations during printing, a gear reduction from the rotation of the motor shaft to the cylinder of, for example, between 2:1 to 10:1, and in particular between 2:1 and 5:1, is of particular advantage. This reduction is particularly beneficial in connection with rpm of cylinders of double circumference from 500 to 850 per minute, and for cylinders of single circumference 1,000 to 1,700 revolutions per minute. The motors run in a preferred range at between 1,000 to 3,000 rpm, and in particular at a range between 1,500 and 2,500 rpm. These ranges are values for steady state operation in the course of production. For a set-up of the printing press, they can, of course, be considerably lower.

In a particularly advantageous embodiment, the use of reduction gears, which are embodied as planetary gears, is suitable for providing a compact structural space and a large range of gear ratios to be realized.

In another advantageous embodiment it is desirable to enscapsulate each gear separately. This can take place in a manner structurally separated from the drive motor, or also in such a way that the drive motor and gear are combined into one structural component.

In a further development of the present invention, the gear of a cylinder, which cylinder must be axially movable for the purpose of adjusting the lateral register, is embodied in such a way that an axial cylinder movement has no effect on the circumferential cylinder register, such as is the case, as a rule, for example in connection with helical gears. In this case, there is also not required any coupling which can be axially changed in length, or an electronic readjustment of the circumferential register.

By the employment of gears with standard, non-helical, surface contact, a pivot cylinder movement, to a limited extent, is possible, for example for the purpose of cylinder engagement and disengagement, without having to move the drive motor or without having to displace the shafts of a rotor and a stator, which is fixed in place on the frame, in respect to each other. Driving each individual cylinder, by the use of its own drive motor permits the most diverse set-up and also permits maintenance work to be performed on the cylinders to a large degree independently of each other and also independently of a possibly drawn-in web of material to be imprinted.

The embodiment of the gears as being axially displaceable in respect to each other, is advantageous particularly in connection with individual gear encapsulation and with the individually driven cylinders. An oil chamber extending over several components is avoided, and it is furthermore possible to make considerably savings in structural space.

In an advantageous embodiment, rotatory driving of the cylinders takes place by use of respectively individual drive motors, which are independent of the drive mechanisms of each of the other cylinders and which are preferably arranged fixed in place on the frame. The latter has the advantage that the drive motors need not be moved.

To compensate for the pivot movement of the transfer cylinders, a coupling, which compensates for the angles and offset, is arranged between the transfer cylinder and the drive motor. This coupling is embodied as a double-joint or, in an advantageous embodiment as an all-metal coupling. Such an all-metal coupling compensates for any offset and the length change caused by this transfer cylinder pivotal movement, while the rotatory movement is transferred free of play.

The drive mechanism of the forme cylinder also has, for example between the cylinder journal and the drive motor, a coupling which absorbs at least an axial relative movement between the cylinder and the drive motor, and which, in order to be able to also absorb manufacturing tolerances and possibly required adjustment movements of the forme cylinder for adjustment, can be embodied to compensate for at least slight angles and offsets. In an advantageous embodiment, this coupling is also embodied as an all-metal coupling, which absorbs the axial movement by the provision of multi-disk packets, which packets are positively connected in the axial direction with the journal or a shaft of the drive motor.

In an embodiment with printing group cylinders driven individually or in pairs and with additional rollers, also driven individually or in pairs, and being part of an inking or dampening unit, for example being distribution cylinders, the individual or paired encapsulation has considerable advantages with regard to the outlay required and with respect to the structural space required on the driven side. The provision and the sealing of an extensive oil chamber, located between lateral walls of the printing press, is no longer required.

In comparison with the axial rotatory driving directly, via a motor shaft, of the cylinders, rollers or distribution cylinders, driving of the cylinders via a gear can, for one, satisfy the requirement for optimal rpm ranges. This is of particularly great advantage in the case of an inking or dampening unit, which is provided with distribution cylinders, in view of the "unsteady" and uneven stresses.

A separation of the rotatory and the axial movements in the inking and/or dampening unit by the use of driving techniques allows, in one embodiment of the invention, on the one hand, an oil-free and therefore cost-effective and environmentally friendly embodiment. On the other hand, an increased flexibility becomes available by the use of process techniques. For example, it is possible, in a start-up phase of the printing press, to perform the inking, or the dampening of the inking unit, or the dampening unit, without a transverse movement. During printing, the frequency of the cylinder transverse movement can be set independently of the rpm of the distribution cylinder or of the production speed. For instance, this frequency can be maintained constant under changing operating conditions. In this way, an optimal relationship between the lateral movements and the circumferential speed can be set without gears, which could be adjusted for this, and without an oil chamber being required.

The independence of the rotatory driving of the cylinders and of the inking unit opens the possibility of varying the circumferential speeds between the cylinders and/or the inking unit. It also allows the achievement of a high degree of flexibility during set-up operations, such as washing, printing forme changes, pre-inking, rubber blanket washing, etc. which set-up operations are chronologically independent of each other.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
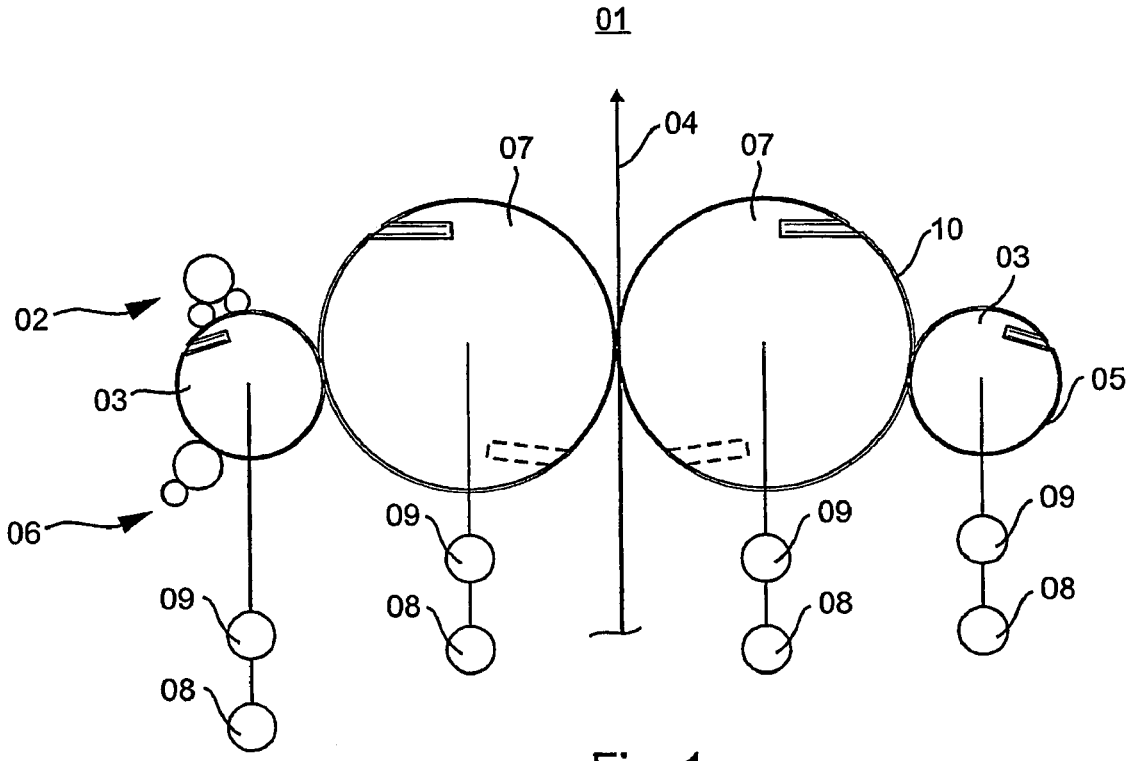
FIG. 1, a side elevation view of a double printing group in accordance with the present invention, omitting the representation of the inking and dampening units for the right cylinder pair, in FIG. 2, a top plan view of the cylinder arrangement in accordance with FIG. 1, in FIG. 3, a side elevation view of a three-cylinder printing group, in FIG. 4, a side elevation view of a printing group with a satellite cylinder, in FIG. 5, a side elevation view of a printing group with two satellite cylinders, in FIG. 6, a side elevation view of a Y-printing group with a double printing group expanded by an additional cylinder pair, in FIG. 7, a schematic representation of a printing unit having four printing groups in a "rubber-against-rubber" embodiment, in FIG. 8, a schematic representation of a printing unit having four printing groups in the embodiment as a "satellite printing unit", in FIG. 9, a side view of the drive units of the printing groups shown in FIG. 7, in FIG. 10, a side view of the drive units of the printing groups shown in FIG. 8, in FIG. 11, a first preferred embodiment of the drive unit of a printing group, using planetary gears, which are symbolically represented, in FIG. 12, a second preferred embodiment of the drive unit of a printing group, using fixed gears with external teeth, in FIG. 13, a third preferred embodiment of the drive unit of a printing group, using internally-toothed fixed gears, in FIG. 14, a double printing group with individually driven cylinders, in FIG. 15, a schematic depiction of a covering of the forme cylinder with four newspaper pages, in FIG. 16, a schematic depiction of a covering of the forme cylinder with eight tabloid pages, in FIG. 17, a schematic depiction of a covering of the forme cylinder with sixteen vertical pages in book format, and in FIG. 18, a schematic depiction of a covering of the forme cylinder with sixteen horizontal pages in book format.

Referring initially to FIG. 1, there may be seen a printing press in accordance with the present invention. The printing press, in particular a rotary printing press, has at least one printing group 01, by use of which ink can be applied, from an inking unit 02, by operation of at least one rotating body 03, which is embodied as a cylinder 03, for example a forme cylinder 03, to a material 04 to be imprinted, for example a web 04 of material to be imprinted, which will be called web 04 for short. In the first embodiment shown in FIG. 1, for embodying the printing unit for rubber-against-rubber printing on both sides, the printing group 01 is configured as an offset printing group 01 for damp offset printing and has, in addition, a further rotating body 07 embodied as a cylinder 07, specifically a so-called transfer cylinder 07. Together with a further impression or printing cylinder 07 constituting the counter-pressure element, the transfer cylinder 07 constitutes a printing position. In the example of FIG. 1, the further impression or printing cylinder 07 is embodied as the transfer cylinder 07 of a second printing group 01, wherein, in this embodiment, the two cooperating printing groups 01 form a so-called double printing group for imprinting both sides of web 04. Unless required for making a distinction, same elements will be provided with the same reference numerals. However, there can be a difference in the spatial positions and, in the case of assigning identical reference numerals, as a rule it is not considered. The web 01 extends substantially vertically through the printing groups, except for loopings.

Figure 2:
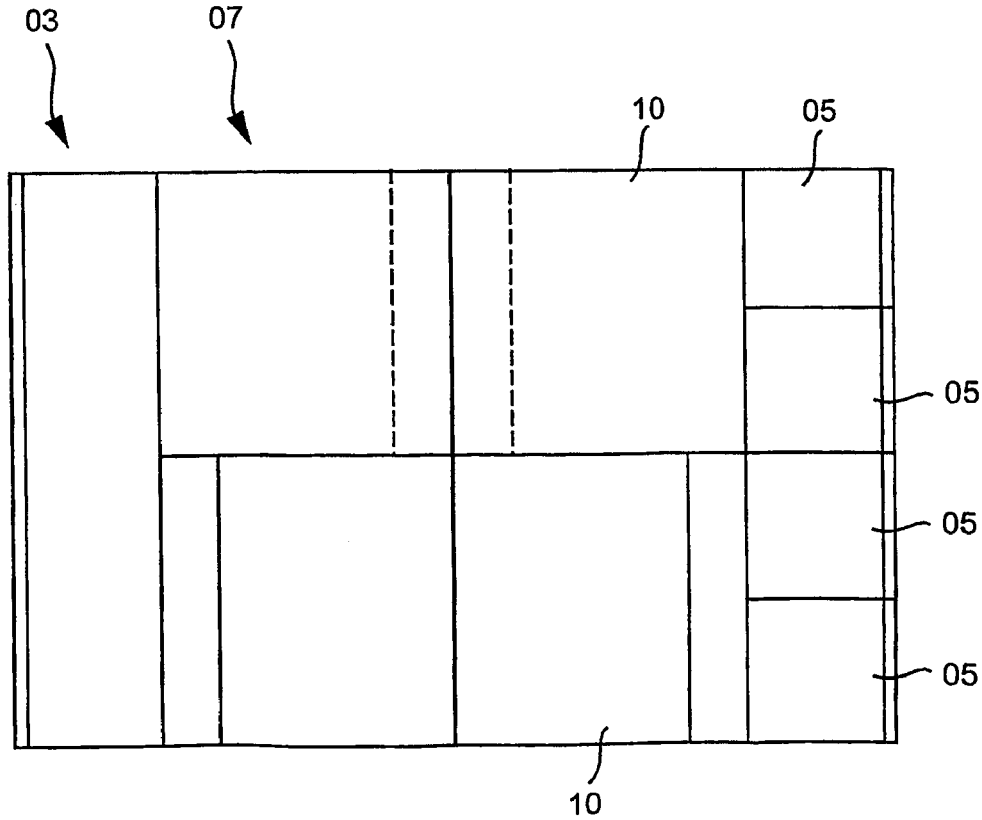

The forme cylinder 03 in accordance with FIGS. 1 and 2 has a circumference, which is adapted for receiving a vertical printed page in broadsheet format, by the use of a flexible printing plate 05, which can be placed on the forme cylinder 03 in the circumferential direction and whose beveled edges, which are arranged on both ends of the plate 05, can each be inserted into a slit extending axis-parallel in the linear direction on the circumference and which beveled edges or ends are fixed in place in the slit or channel by a spring force, by pressure means, or by an assembly which can be actuated by a centrifugal force, such centrifugal force becoming active during operation. For improved securing of the edge of the printing plate 05 which is leading in the direction of rotation of the forme cylinder 03, its opening at the circumference is advantageously inclined in the direction of rotation of the forme cylinder 03.

The length of the forme cylinder 03 is dimensioned for receiving at least four vertical printed pages, in broadsheet format, as seen in FIG. 2 at the right. In connection with this, it depends, inter alia on the production to be provided, whether only one printed page or several printed pages are each arranged on a printing plate 05. The printing plates 05 can be mounted, without problems, in the circumferential direction on the forme cylinder 03 and, in the embodiment represented in FIG. 1, can be individually exchanged as an individual printing plate.

In contrast to the forme cylinder, the transfer cylinder 07 has a double circumference and is covered, in the linear or axial direction with two rubber blankets 10 arranged side-by-side. In a manner which is not specifically represented, the two ends of the rubber blankets 10 can be braced and fastened in an axis-parallel groove, which groove is open at the circumference of the transfer cylinder 07. However, in the configuration shown in FIG. 1, each of the rubber blankets 10 is fastened on a support plate, which is not specifically represented, whose ends, which are protruding past the rubber blanket 10, are each provided with a bent edge which, in a manner analogous to the printing plate 05, can be inserted into an axis-parallel slit at the circumference of the transfer cylinder 07 and, if required, can be additionally fixed in place for securement against their sliding out. Because of the double circumference of the transfer cylinder 07, in respect to the forme cylinder 03, the two slits for the rubber blankets 10 are offset from each other by 180°, thereby positively affecting the oscillation behavior of the printing group in the operational state. In FIG. 1 only the slit for the front rubber blanket 10 is visible. In an advantageous manner, two slits are arranged side-by-side in the linear direction of the transfer cylinder 07 which slits, however, are offset in the circumferential direction.

The ratio of a length of the forme cylinder 03 to its diameter lies between 7 to 1 and 10 to 1, and, in particular at 8.5 to 1 to 9.5 to 1. The length of the barrels of the cylinders 03, 07 lies between 1,100 to 1,800 mm, in particular between 1,400 and 1,700 mm.

Figure 8:
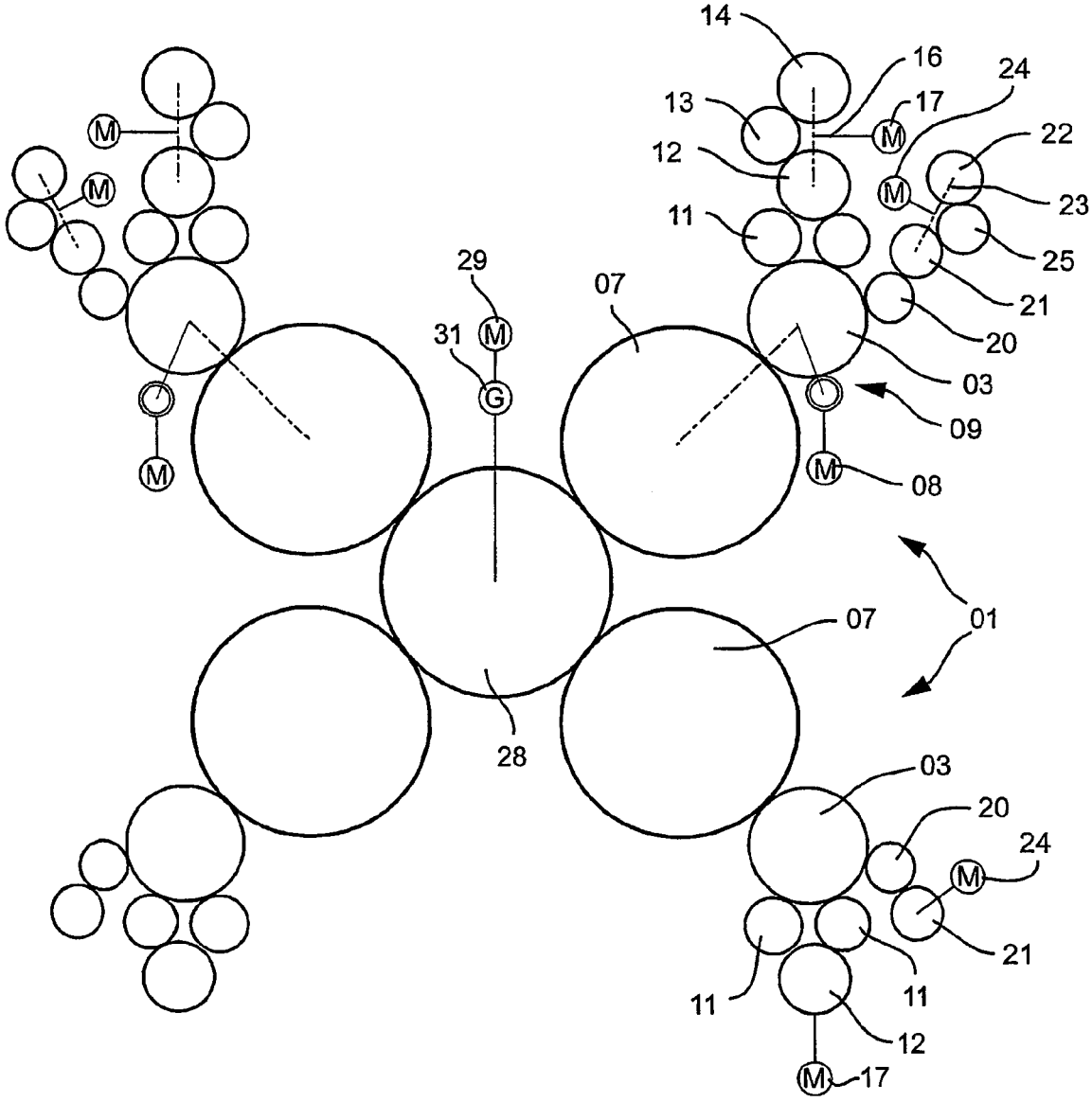

In a preferred embodiment, the cylinders 03, 07, which are also called printing group cylinders 03, 07, have at least in pairs, which are represented by way of example in FIG. 8, a drive motor 08 for each printing group 01, which drive motor 08 is independent of further printing groups 01. It can drive one of the two printing group cylinder 03, 07 either directly, or via a gear, a pinion, a toothed belt, or the like and from there, the other one of the two printing group cylinders 03, 07, or it can drive both printing group cylinders 03, 07 in parallel. With this embodiment, a gear wheel-less drive unit, for example, favors oil-free driving, or with a closed, for example encapsulated, gear for only the two side-by-side arranged printing group cylinders 03, 07, it favors the saving of an oil chamber between frame walls.

In an embodiment, which is advantageous, because of it being even more flexible, and being suited particularly for oil-free driving, each one of the printing group cylinders 03, 07 has its own drive motor 08, which again drives the respective printing group cylinder 03, 07 axially, for example via a gear 09, or laterally offset via a gear, such as a pinion, or a toothed belt, as seen in FIG. 1.

Besides the above-described variation of a printing group in accordance with the present invention, which is configured for four printed pages arranged side-by-side, printing groups can also be realized which have forme cylinders which can be equipped in the linear direction with more than four vertical printed pages in broadsheet format.

The drive motors 08 are advantageously embodied as electric motors, and in particular as asynchronous motors, synchronous motors, or as d.c. motors.

In contrast to the depicted representation, it is also possible to operate such a printing group in a dry offset method or by use of ink containing the dampening fluid as an admixure.

In place of finite rubber blankets, it is also possible to embody the transfer cylinders without a slit for use with rubber blanket sleeves, which sleeves can be pushed on the cylinder circumference in the axial direction by the use of an air cushion. However, for this purpose, the transfer cylinder must be releasable from its seating in the press frame on one side for changing the rubber blanket sleeve.

Figure 3:
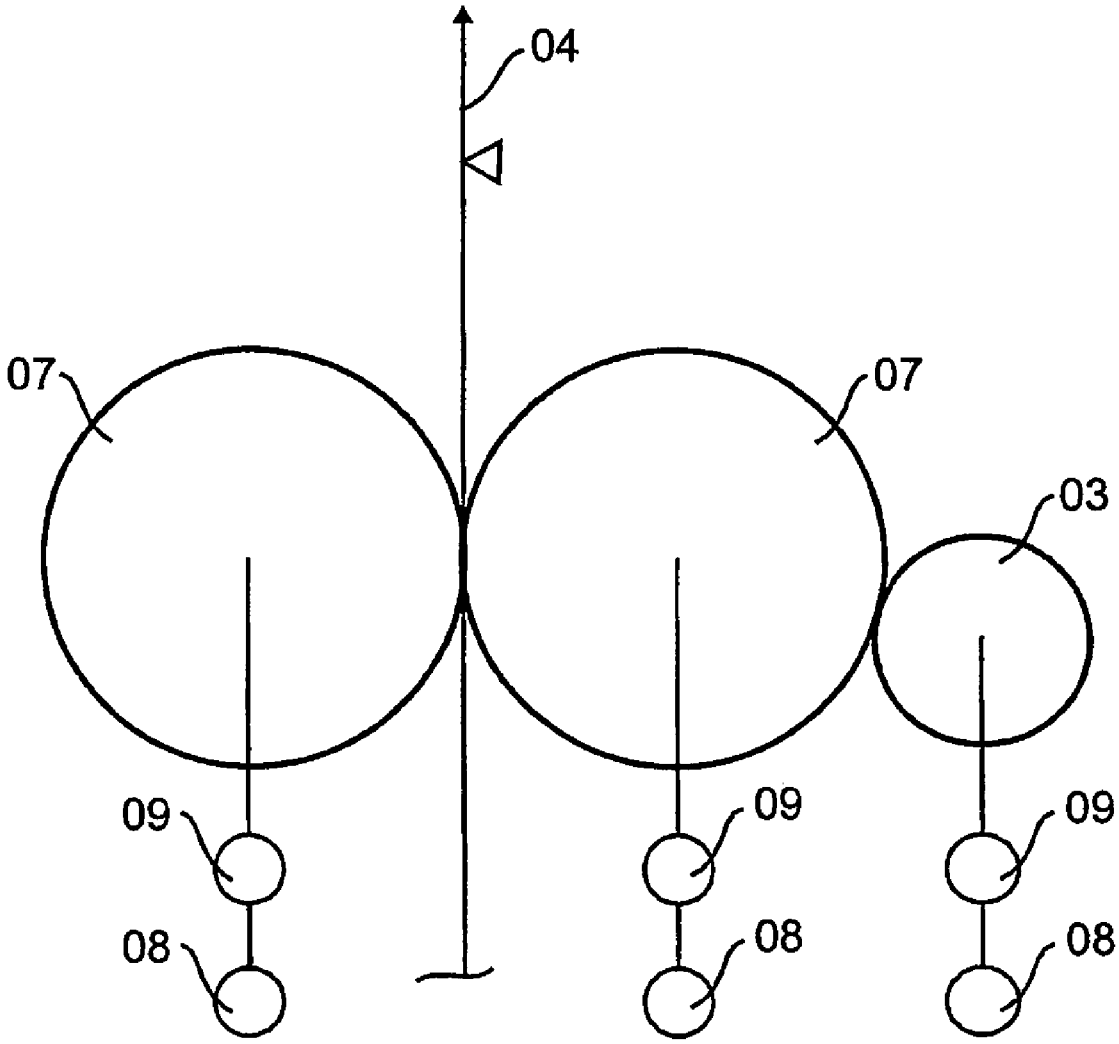

FIG. 3 schematically shows a three-cylinder printing group with a cylinder pair consisting of a transfer cylinder 07 and a cylinder configured identically to the ones shown in FIG. 2, whose transfer cylinder 07 works together with a printing cylinder 03 of the same size as the counter-pressure cylinder 07, covering a web 04 of material to be printed, which passes vertically between the two cylinders, on one side with ink.

Driving is performed in a manner analogous to FIG. 1.

Figure 4:
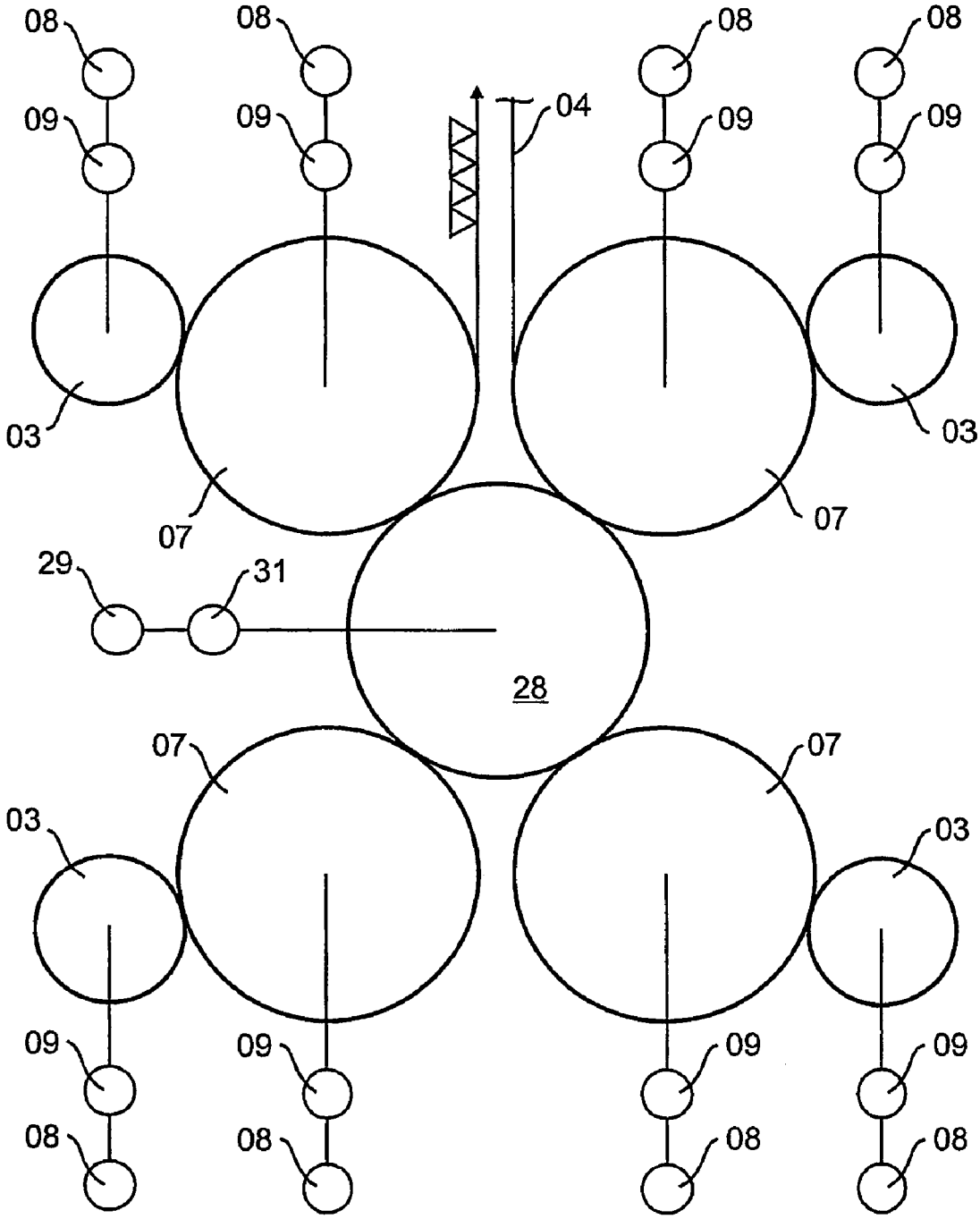

FIG. 4 shows a printing cylinder 28 in the form of a satellite cylinder 28, which works together with the transfer cylinders 07 of two cylinder pairs, each of which cylinder pairs consisting of a forme cylinder 03 and of a transfer cylinder 07, wherein a web 04 of material to be imprinted, which loops around the satellite cylinder 28, is covered, at four printing positions one after the other, on the same side with one color ink applied by each of the four transfer cylinders 07.

Driving of each cylinder 03, 07, 28 takes place, for example, again with a drive motor 08, 20 each via one of a gear 09 or 31, respectively. However, in another embodiment, which is not specifically represented, the forme and transfer cylinders 03, 07 can also be driven in pairs by a common drive motor 08.

Figure 5:
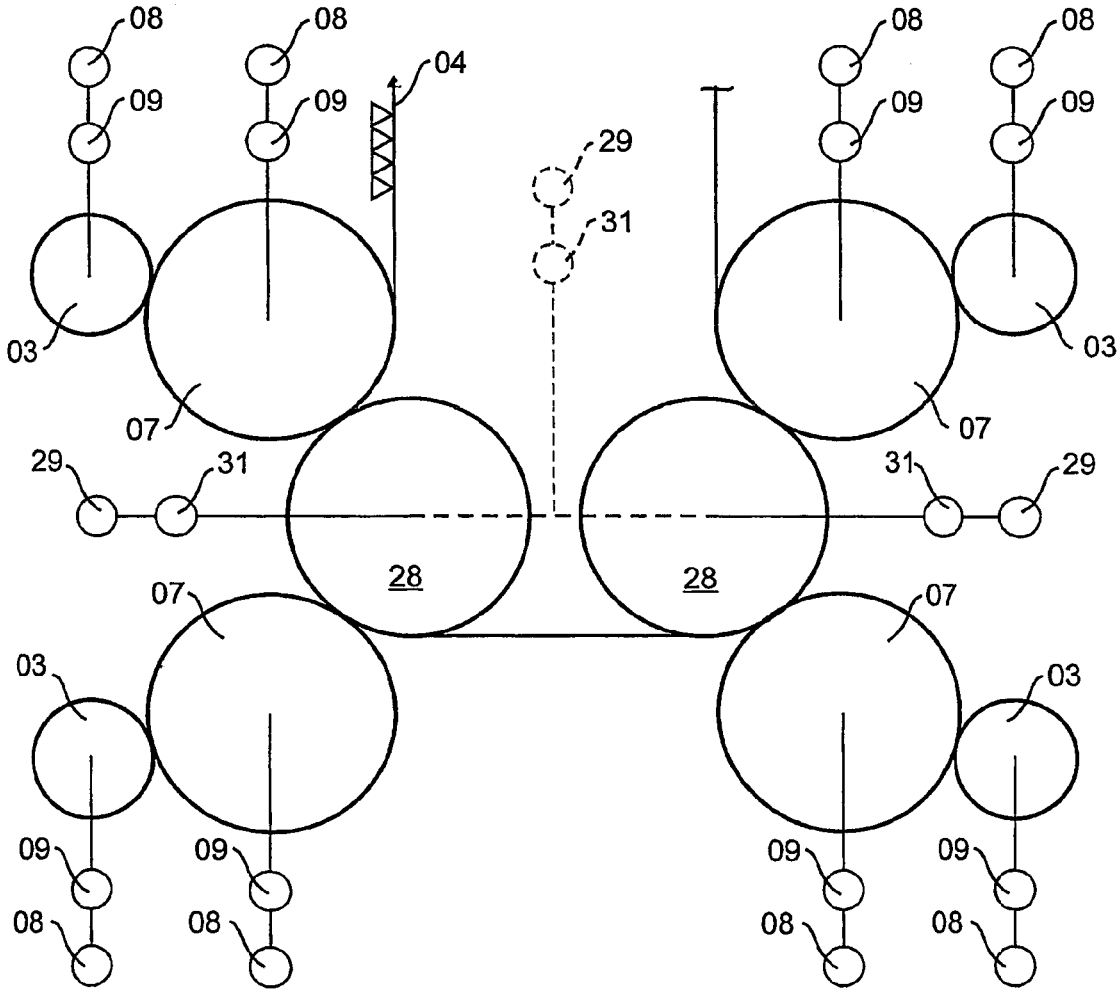

In FIG. 5, two printing cylinders, each in the form of a satellite cylinder 28, work together with two transfer cylinders 07 each of a cylinder pair consisting of a forme cylinder 03 and of a transfer cylinder 07. A web 04 of material to be imprinted, which successively loops around the two satellite cylinders 28, is covered with ink at two printing positions for each satellite cylinder 28, one after the other, on the same side.

Driving of each cylinder 03, 07, 28 again takes place by use of each cylinder's own drive motor 08, 29 via a gear 09, 31. If required, the satellite cylinders 28 can also be driven together, as shown in dashed lines, by one drive motor 29.

Figure 6:
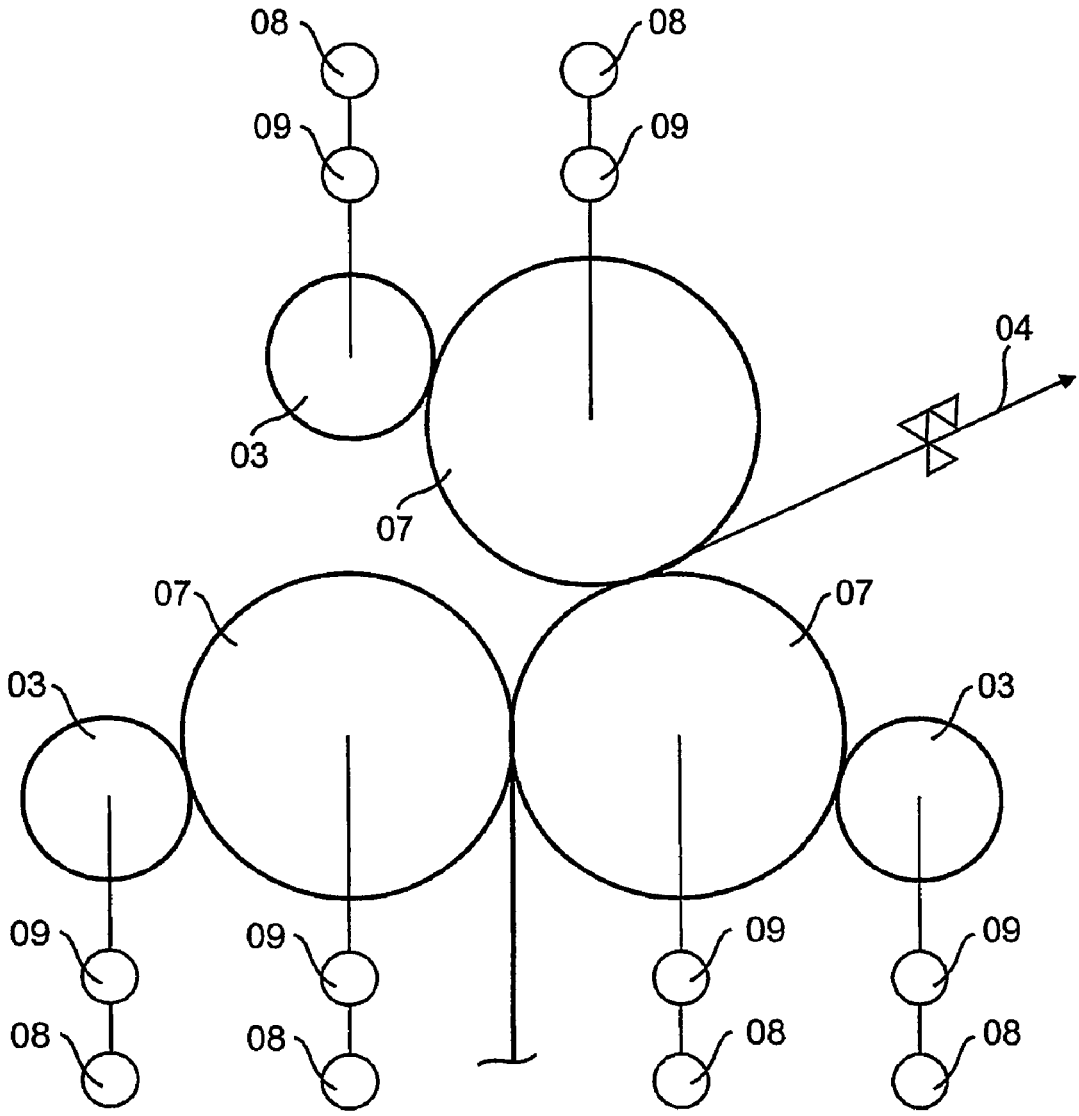

FIG. 6 shows a double printing group embodied analogously to FIG. 1 and FIG. 2 which, by the provision of a further cylinder pair, consisting of a transfer cylinder 07 and a forme cylinder 03, has been expanded into a Y-printing group, wherein the transfer cylinder 07 of the further cylinder pair works together with the transfer cylinder 07 of the double printing group, seated fixed in place in the machine frame, to cover a web 04 to be imprinted additionally with a second color ink on one side.

Driving of this Y-printing group takes place in the same manner as in the above mentioned embodiments.

Figure 7:
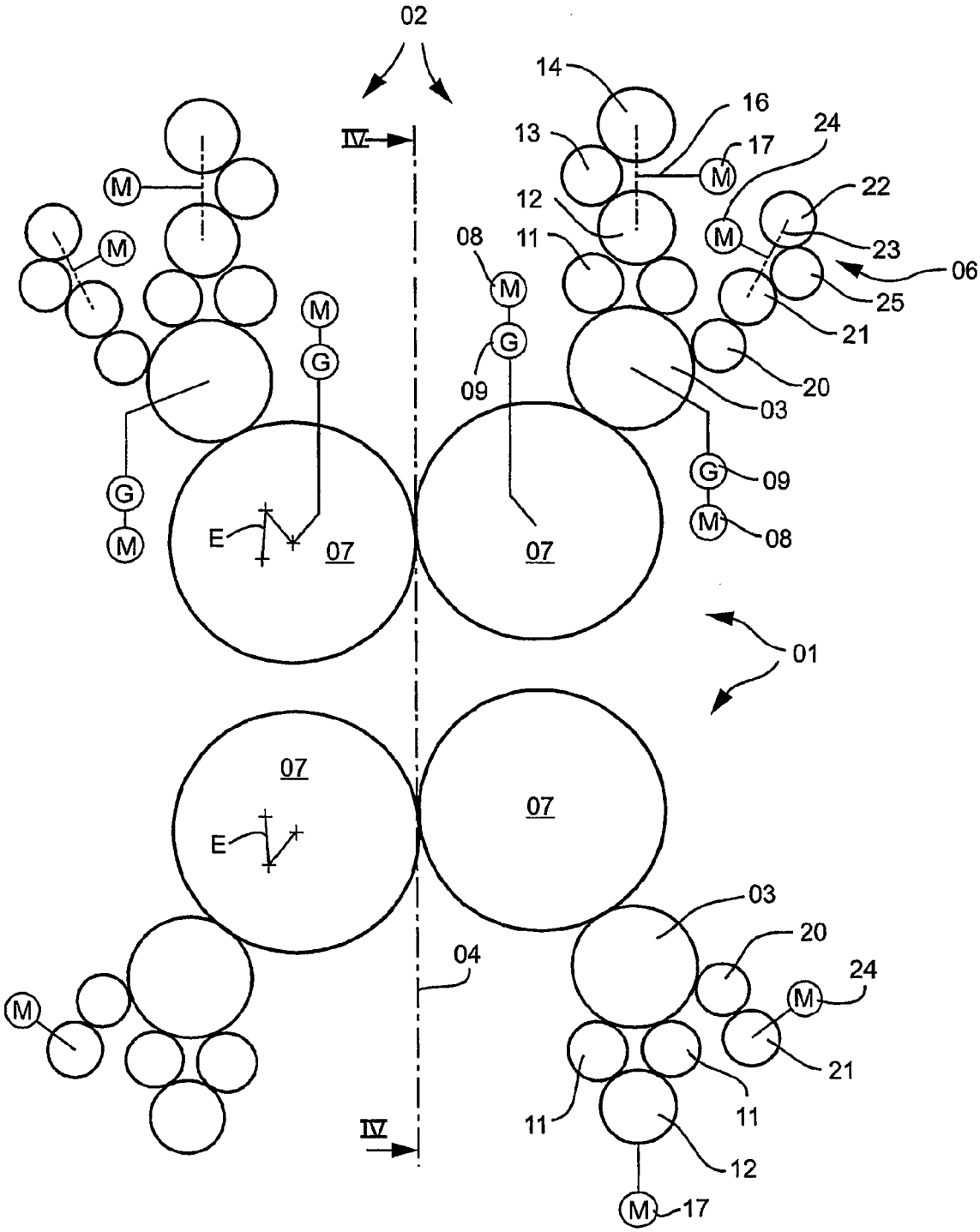

As schematically represented in FIG. 7, which shows a printing unit with four printing groups, for the upper two printing groups 01, the inking units 02 each have a plurality of rollers 11, 12, 13, 14, of which plurality of rollers the applicator rollers 11, the transfer roller 13 and the distribution cylinders 12 and 14 are identified in the drawings. The conveyance of ink from a supply system or a supply stock to the distribution cylinder 14 can take place in various ways.

Figure 9:
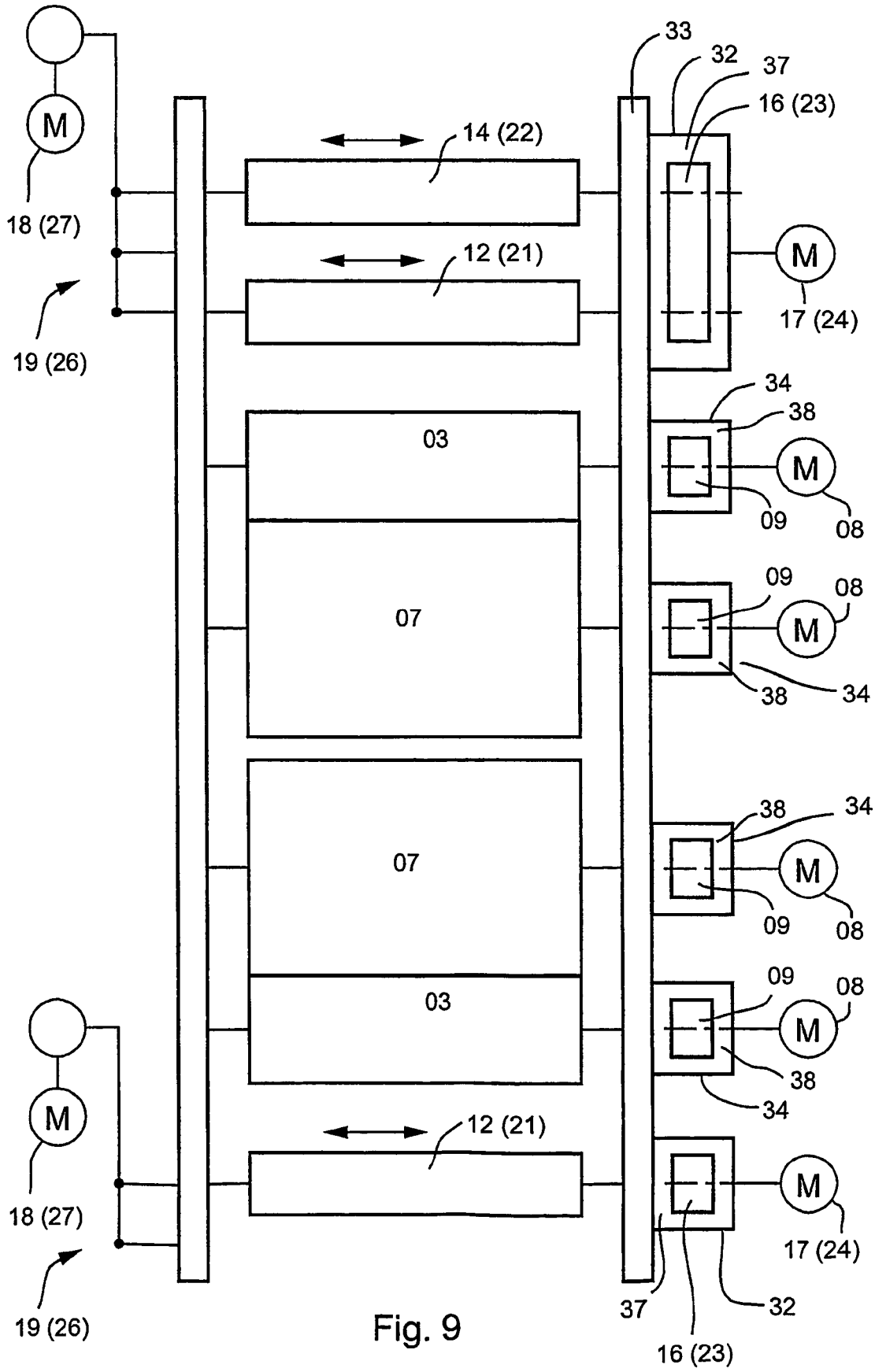

The two distribution cylinders 12, 14 of the inking unit 02 represent rotating bodies 12, 14, which are rotatably seated around their longitudinal axes, but which are movable in the axial direction in relation to the cooperating rollers. In this preferred embodiment, the distribution cylinders 12, 14 are rotatorily driven via a gear 16, and preferably together by a common drive motor 17, which drive motor 17 is independent of the drive unit of the printing group cylinders 03, 07. If necessary, the distribution cylinders 12, 14 can also be rotatorily driven individually, each by a gear 16 and an individual drive motor 17. They are driven, preferably together, for movement in the axial direction of the distribution cylinders 12, 14, by a further drive means 18, which is also independent of the drive unit of the printing group cylinders 03, 07, and which may be, for example, a drive motor 18 as depicted in FIG. 9, via a further gear 19, for example via a crank mechanism 19, so that they perform a traversing movement around an amplitude swing which is preferably adjustable. If several distribution cylinders 12, 14 can be axially driven together via a gear 19, in an advantageous embodiment, the phase and/or the swing of the traversing movement of each single, mutually driven distribution cylinder 12, 14 can be adjusted independently of each other. The axial drive units are not represented in FIG. 7. Reference symbols have only been shown for the right half of the printing unit, since the left side corresponds to the right one in a mirror-reversed way.

In place of, or in addition to the distribution cylinders 12, 14, it is also possible to rotatorily drive other rollers 11, 13, etc. of the inking unit 02 individually or together via a gear 16, also from the drive motor 17.

In the preferred embodiment of the upper printing groups 01 shown in FIG. 7, each forme cylinder is also contacted by a dampening unit 06 which also has several rollers 20, 21, 22, 25, which dampening unit rollers include at least one application roller 20, at least two distribution cylinders 21, 22 and a transfer cylinder 25. Here, too, the distribution cylinders 21, 22 for example can be rotatorily moved via a gear 23 by a common drive motor 24. They can be moved in the axial direction via a gear 26 by use of a common drive mechanism 27, for example a drive motor 27, again as seen in FIG. 9. Instead of, or in addition to the distribution cylinders 21, 22, other rollers 20, 25, etc. of the dampening unit 06 can also be rotatorily driven individually or together via a gear 23.

At least one of the two cooperating transfer cylinders 07 can be moved away, for example by the use of a symbolically represented eccentric device, as depicted in FIG. 7 from the other transfer cylinder 07 and, depending on the track of the web 04. This transfer cylinder 07 can be simultaneously moved away from it. Both cooperating transfer cylinders 07 can be pivotably seated.

In an advantageous further development, the transfer cylinders 07 can be moved away from each other to such an extent that during production operation, the web 04 can be passed between these transfer cylinders 07 without touching them. Thus, at one time, during so-called imprinter operations, the transfer cylinders 07 of the upper printing group 01 can be engaged for printing, while set-up can take place in the lower printing group 01, and vice versa.

It is also possible to seat the forme cylinder 03 to be movable in such a way that during imprinter operations, a guidance of the web 04 is maintained by the transfer cylinders 07, while the disengaged forme cylinder 03 is being equipped with a fresh printing forme 05.

A preferred embodiment of the present invention, for an adaption of the printing unit as a satellite printing group, is represented in FIG. 8. The transfer cylinder 07 of the printing group 01 forms a printing position together with a rotating body 28, which is embodied as a satellite cylinder 28. Again, the satellite cylinder 28 is individually rotatorily driven by its own drive motor 29 via a gear 31. In a non-represented embodiment, the satellite printing unit has two such satellite cylinders 28, each of which can be driven individually, but which also can be driven together, by a common drive motor 29 via the gear 31. The axial drive units are not represented in FIG. 8.

The driving in pairs of the printing group cylinders 03, 07 via a pinion, which drives a drive wheel of the forme cylinder 03 as a portion of the gear 09, is represented in FIG. 8 by way of example. It is then possible to transfer power from the drive wheel of the forme cylinder 03 to the drive wheel of the transfer cylinder 07. This can be provided by a gear wheel connection as a part of the, for example encapsulated, gear 09, or by belts. The transfer cylinder 07 can also be driven and from there the forme cylinder 03 can be driven.

The embodiment of the present invention described in connection with FIGS. 7 and 8 by referring to the upper printing group 01, can be equally applied to the lower printing groups 01, and vice versa. However, the inking units 02 and the dampening units 06 are represented with only one distribution cylinder 12, 21 in the lower printing units 01 in FIGS. 7 and 8 by way of example. In an advantageous embodiment, these inking units 02 and dampening units 06 are rotatorily driven by respective drive motors 17, 24 via the gears 16, 23, as represented in FIGS. 7 and 8, and in the axial direction, which is not represented, by provision of the drive motors 18, 27 via the gears 19, 26 as shown in FIG. 9.

Figure 10:
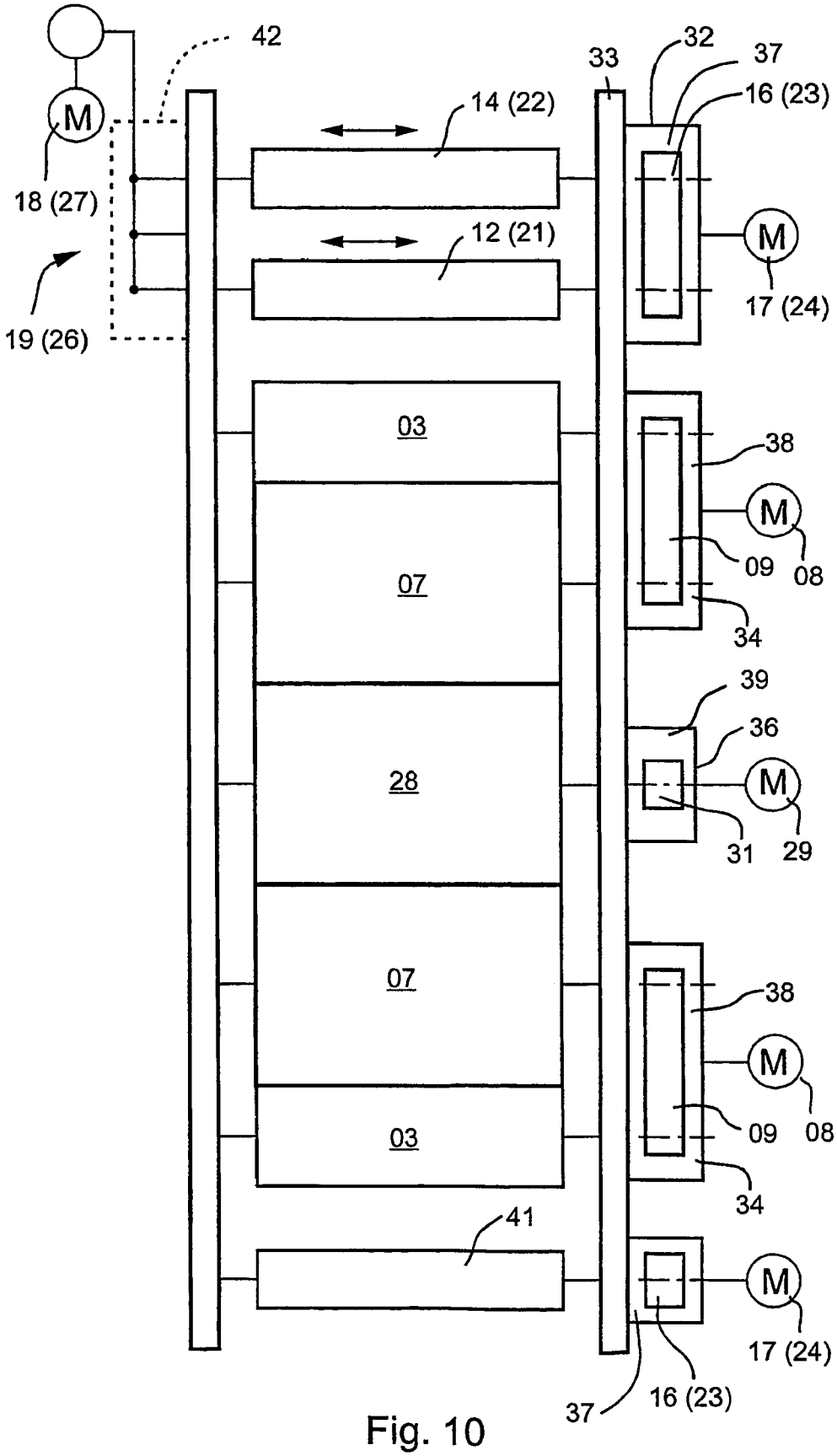

FIGS. 9 and 10 represent the embodiments shown in FIGS. 7 and 8, in a side view, but the representation of the rollers 11, 13 has been omitted. The dampening units 06, if provided, are also not visible in this representation. However, what has been discussed with respect to the inking units 02 should be correspondingly applied to the dampening units 06. For this reason, the reference numerals of the distribution cylinders 21, 22, the gear 23, 26, as well as the drive motors 24, 27 have been placed in parentheses in FIGS. 9 and 10 next to the reference numerals of the inking units 02.

In FIG. 9 two rollers 11, 12, 13, 14, which in this case are the distribution rollers 12, 14 of the upper inking unit 02, have the common drive motor 17. In this embodiment, the gear 16, for example in the form of a gear wheel train 16, is embodied to be closed toward the outside. For this purpose, the gear 16 assigned to the two distribution cylinders 12, 14 is arranged in a housing 32 which is assigned to this gear 16 only. For example, this housing 32 can have an open side which, together with a lateral frame 33 forms a closed encapsulated chamber 37. The lower inking system 02 which, by way of example, only has one driven roller 11, 12, 13, 14, for example a distribution roller 12, also has a housing 32 assigned only to this roller 11, 12, 13, 14, for example the one distribution roller 12, and forms an encapsulated chamber 37 together with the lateral frame 33, which chamber 37 receives the gear 16.

The drive motor 18, as well as the gear 19 for axial movement are, for example, arranged on an opposite side of the press from the chambers 37.

The printing group cylinders 03, 07 all have their own drive motor 08 and, in this embodiment, a housing 34 which only receives the respective gear 09 for each cylinder group 01.

Differing from FIG. 9, in the preferred embodiment of the present invention, in accordance with FIG. 10, the printing unit has the satellite cylinder or cylinders 28, which is or are driven by their own or a common drive motor 29 via the gear 31. An individual housing 36 has also been assigned to it or them, which receives the gear 31 and encapsulates it on the outside of the lateral frame 33.

In this example, the pairs of two printing group cylinders 03, 07 have the common drive motor 08 and the housing 34 receiving the respective gear 09.

A preferred embodiment of the drive unit of a printing group is represented in the lower area of FIG. 10, which has a roller 41, for example a screen or anilox roller 41, which is rotatorily driven by the drive motor 17 via the encapsulated gear 16, and which is provided with small cups on the surface. The screen roller 41 transfers the ink, for example to one or two applicator rollers 11, which are not specifically represented. It does not perform a traversing movement.

The gears 09, 16, 23, 31 are embodied as individually encapsulated gears 09, 16, 23, 31, which are assigned to several cylinders 03, 07, 28, or rollers 12, 14, 21, 22 of the same structural component, or to an individual cylinder 03, 07, 28, or roller 12, 14, 21, 22, 41. In this case, the pair of printing group cylinders 03, 07, the rollers 11, 12, 13, 14, in particular the distribution cylinders 12, 14 of the inking unit 02, and the rollers 20, 21, 22, 25, in particular the distribution rollers 21, 22 of the dampening unit 06, are understood to be the structural component.

The gears 09, 16, 31 are arranged in a closed, spatially closely restricted chamber 37, 38, 39 by the housing 32, 34, 36, in which housing a lubricant, such as oil for example, can be provided, and which lubricant is not able to escape from the chamber 37, 38, 39, and without a necessity of a multi-walled lateral frame.

The arrangement of a drive motor 17, 24, 29 with gears 09, 16, 23, 31 placed on it, or flanged to the drive motor, and an individually encapsulated gear 09, 16, 23, 31, such as an encapsulated planetary or reduction gear, is particularly advantageous, in particular also in case of the individual driving of a roller 11, 12, 13, 14, 20, 21, 22, 25, 41 of the distribution cylinder 12, 14, 21, 22, of a printing group cylinder 03, 07, or a satellite cylinder 28.

In an advantageous embodiment, all of the gears 09, 16, 23, 31, or at least the gears of the inking unit 02 and/or dampening units 06, are embodied as reduction gears 16, 23. The gears 16, 23 for use in the paired driving of two distribution cylinders 12, 14, 21, 22 are preferably embodied in such a way that the two distribution cylinders 12, 14, 21, 22 have the same direction of rotation, i. e. in case of an embodiment of the gear as a gear wheel train between drive wheels of the two distribution cylinders 12, 14, 21, 22, an intermediate wheel is arranged. In this case, driving can take place by operation of the drive motor 17, 24 driving one of the drive wheels or the intermediate wheel. The gears 09, 16, 23, 31 can also have a traction gear, for example a belt drive, in particular a toothed belt drive or, in an advantageous embodiment of one or several of the gears 09, 16, 23, 31, they can be embodied as traction gears with traction devices, in particular with toothed belts. For example, a gear 09, 16, 23, 31, for driving one or several of the distribution cylinders 12, 14, 21, 22, can be embodied as a belt drive with toothed belts.

In an advantageous embodiment, the gear 16, 23 of the traversing distribution rollers 12, 14, 21, 22 is embodied in such a way that the rotatory drive motor 17, 24 can be arranged so that it is fixed in place on the frame. This is possible, for example, by use of a spur gear, or by use of an above mentioned belt drive with an axially movable drive wheel or with an extra wide drive wheel, on which drive wheel the belt, which may be, for example a toothed belt, can run helically when the distribution cylinder 12, 14, 21, 22 moves.

The axial drive unit, or its gear 19, 26, which transfers or converts the axial movement to or of the distribution cylinder 12, 14, 21, 22, is, in an advantageous embodiment, not located in a lubricant or oil chamber. If lubricant is required, the gear 19, 26 is embodied at least as an encapsulated gear 19, 26 which is closed off toward the exterior and is encapsulated, and which is assigned only to the drive motor 18, 27 which drives this gear 19, 26. For this purpose, a housing 42 is indicated by dashed lines, as an example, in FIG. 10. A gear 19, 26 which is axially driving one or several distribution cylinders 12, 14, 21, 22, can also have a traction gear, and in particular a toothed belt, or can be embodied as such.

For the case of the axial drive by use of the drive motor 18, 27, the gear 19, 26, that is used for converting the rotatory movement into an axial swing, is arranged outside of the barrel of the distribution cylinder 12, 14, 21, 22, but not in an extended common oil or lubricant chamber, together with gears of components, for example an adjoining inking or dampening unit 02, 06, or a printing group cylinder 03, 07. The drive motor 18, 27 itself, however, can have its own encapsulated gear, which is not specifically represented, for example a reduction gear and/or an angular gear. In this embodiment, the converting and/or reducing gear 19, 26 is, for example, embodied as a crank gear having an eccentric, as a detent revolving in a curved groove, or in any other way.

In a further development, the axial driving is not performed by the drive 18, 27, which is embodied as drive motor 18, 27, but instead by a piston, for example, which piston can be charged with a pressure medium, or by a magnetic force. In this case, a coupler, for example, constitutes the transferring or converting gear 19, 26. These drive variations are advantageous, for example, together with the individually encapsulated rotary drive.

The variations of the individual or of the paired rotatory drive units and of the assigned gears 09, 16, 23, 31, as well as of the individual or paired axial drive units and their assigned gears 19, 27 represented by the preferred embodiments are each shown by way of example in the printing groups 01 represented "on top" or "on the bottom" of FIGS. 7 to 10 for the purpose of a space-saving representation. In particular, a printing unit can have four printing groups 01, all of which printing groups each have an inking unit 02 with two distribution cylinders 12, 14, and a dampening unit 06 with a distribution cylinder 21. All of the inking units 02 can also have the driven screen roller 41 shown in FIG. 10 instead of the driven distribution cylinders 12, 14. Also, for the combination of the drive units for the cylinders 03, 07, 28 with those of the inking or dampening units 02, 06, the statements made in the discussion of the embodiments shown in FIGS. 7 and 9 should also be transferred to the statements made in the discussion of the embodiments shown in FIGS. 8 and 10, and vice versa. For example, all cylinders 03, 07, 28, and all rollers 11, 12, 13, 14, 20, 21, 22, 25 to be driven can each have, depending on the embodiment, their own rotatory drive motor 08, 17, 24, 29 via an individually encapsulated gear 09, 16, 23, 31. The various represented and above mentioned variations of the axial drive units are additionally to be reciprocally applied to the various printing groups 01.

Thus, the printing unit can, for example, have four printing groups 01, whose printing group cylinders 03, 07 are each rotatorily driven by their own drive motor 08 via their own encapsulated gear 09, while the inking and the dampening units 02, 06 each have two distribution cylinders 12, 14, 21, 22, which can be rotatorily driven in pairs by a common drive 17, 24 each via an encapsulated gear 16, 23, and axially in pairs by a common drive means 18, 27 via a gear 19, 26.

For a printing unit, preferably the same configuration of all printing groups 01 constituting the printing unit is selected. The selection of the particular embodiment depends on the degree of flexibility desired, the costs, and the selection of the inking unit 02 or the dampening unit 06, with one or two distribution cylinders 12, 14, 21, 22, or a short inking unit with a screen roller 41, etc.

Figure 11:
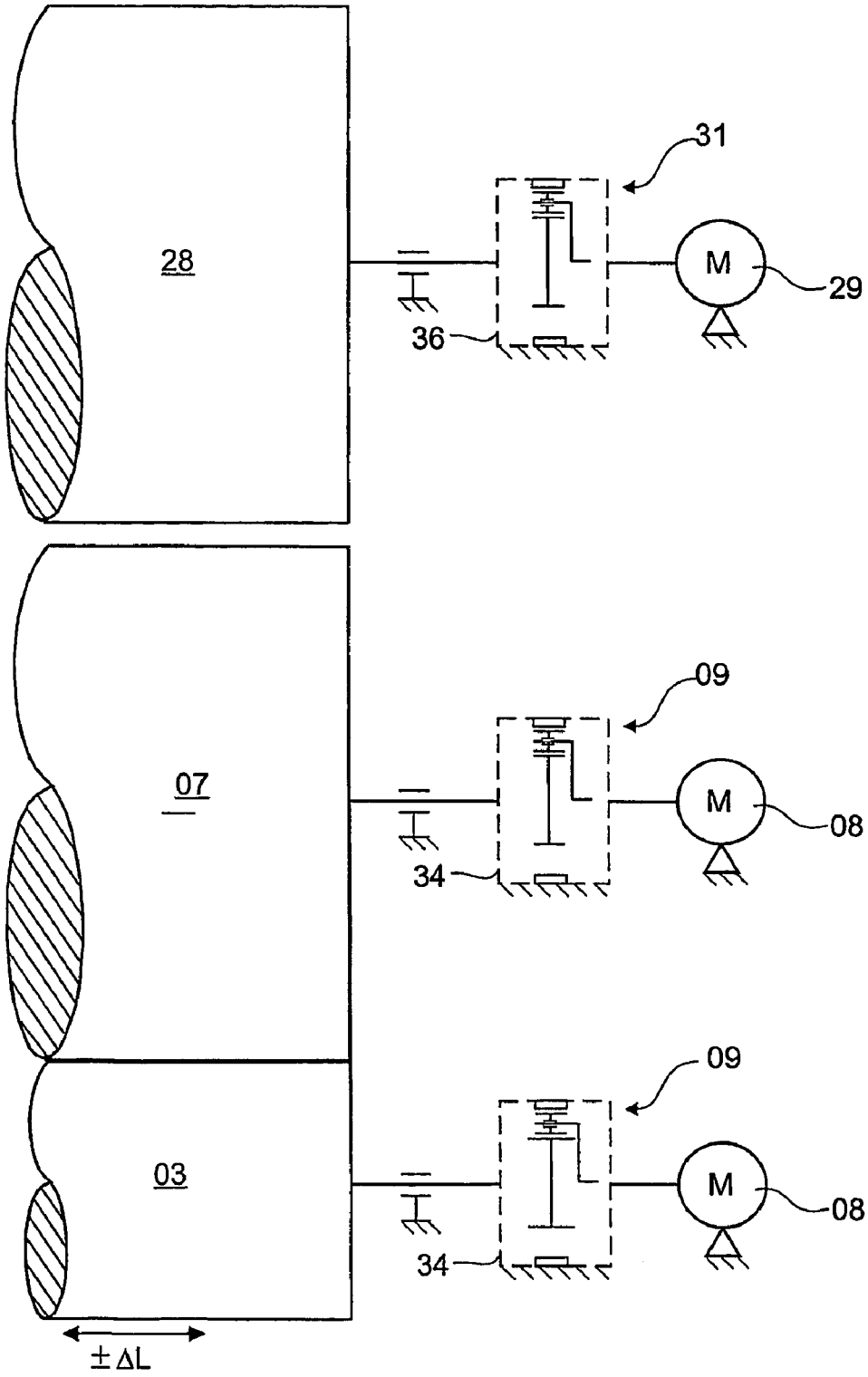
Figure 12:
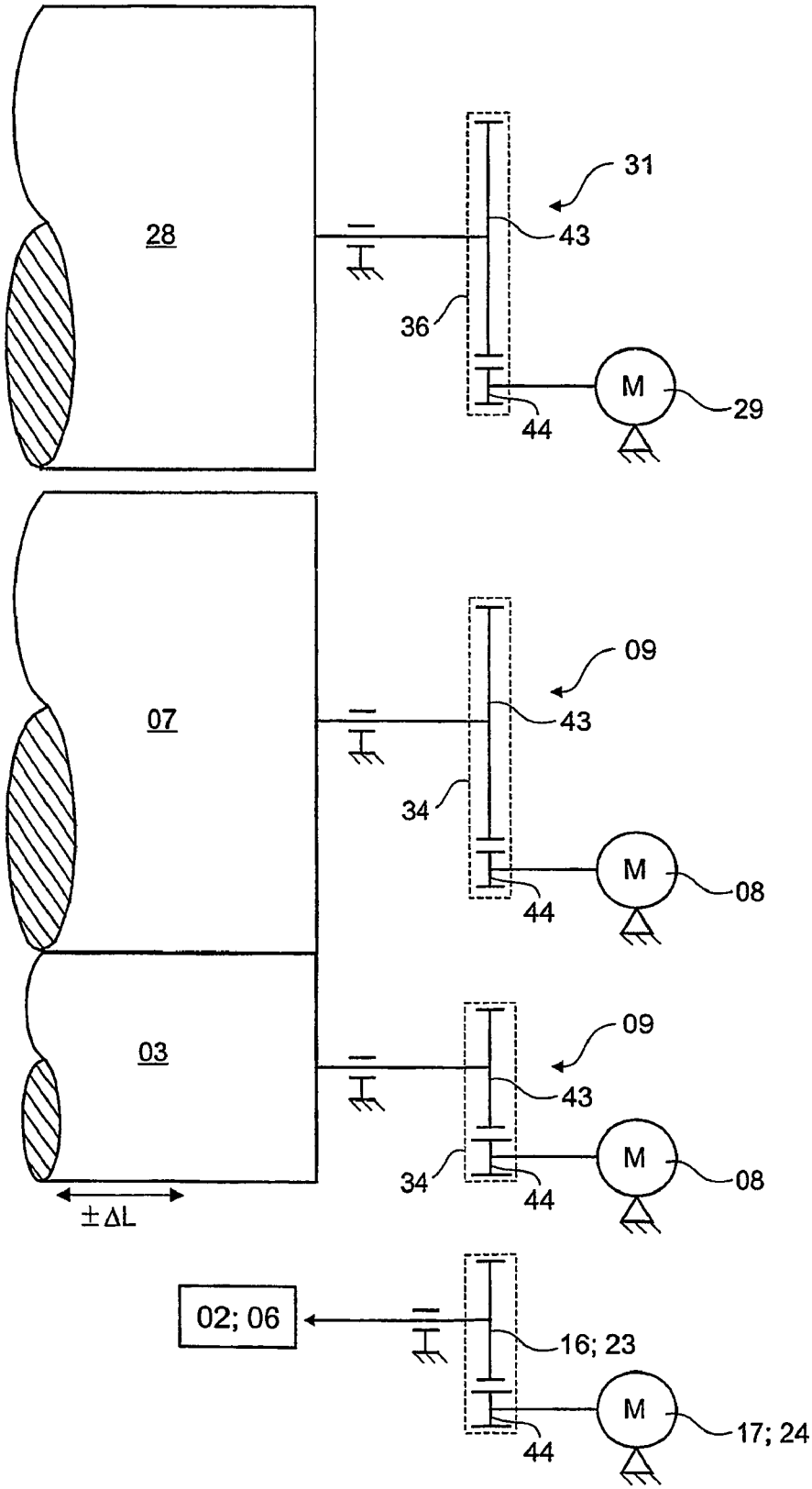
Figure 13:
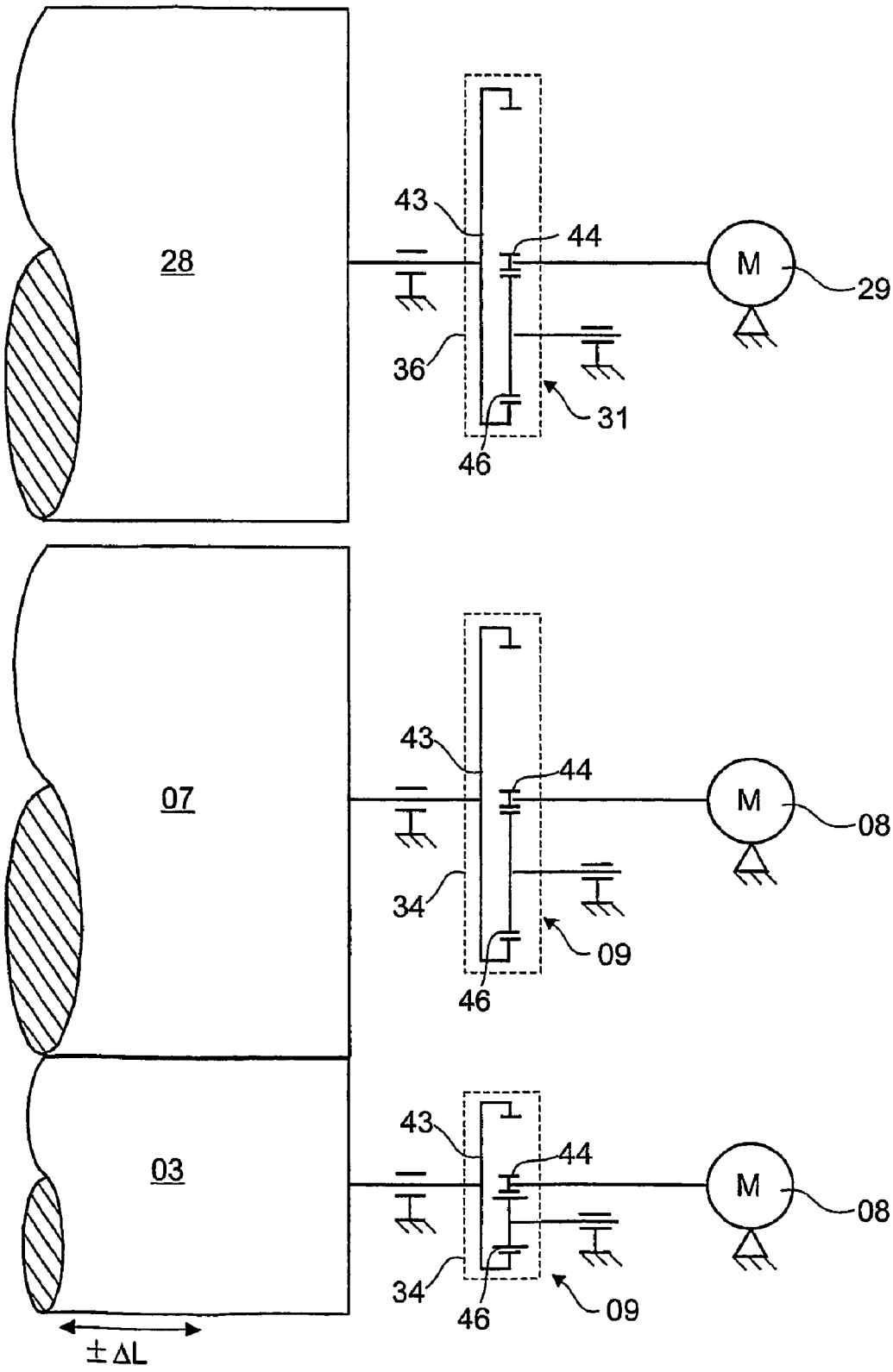

Advantageous embodiments of the above mentioned individual driving of the cylinders 03, 07, 28 are represented in the following preferred embodiments of the present invention, as shown in FIG. 11 to FIG. 13.

The end of the forme cylinder 03 is in an operative connection with the drive motor 08 via the gear 09 for rotatory driving.

The end of the second cylinder 07, which may be embodied as the transfer cylinder 07, is also in an operative connection with a drive motor 08 via the gear 09 for rotatory driving.

For direct printing processes, the second cylinder 07 can also be embodied as a counter-pressure cylinder 07, wherein a printing position is formed between the forme and the counter-pressure cylinders 03, 07.

The two cylinders 03, 07 are not in a positive driving connection with each other and are driven, mechanically independent of each other, by the respective drive motor 08 via the respective gear 09.

In a print-on position, the transfer cylinder 07 acts together via the web 04 of material to be imprinted with the third cylinder 28, which is embodied as a counter-pressure cylinder 28. In the case of a double printing group, such as is shown in FIGS. 1, 2, 6, 7, 9, the third cylinder 28 can be embodied as a further transfer cylinder 07 for simultaneous obverse and reverse printing of the web 04 in accordance with the "rubber-against-rubber" principle, which further transfer cylinder 07 acts together with the further forme cylinder 03, not represented. In the preferred embodiment shown in FIG. 11, the third cylinder 28 is embodied as a satellite cylinder 28, which can act at its circumference together with further pairs of cylinders corresponding to the cylinder pair 03, 07.

The third cylinder 28 can be driven without a mechanical driving connection with the first two cylinders 03, 07, except for a friction gear connection which is constituted by the cylinders 03, 07 rolling off on each other.

In a preferred embodiment, the third cylinder 28 is also in operative connection for rotatory driving with its own drive motor 29 via the gear 31. In a further development of the present invention, at least the forme cylinder 03 is embodied to be movable in its axial direction up to an amount $\Delta L$ for setting the linear register, and this linear displacement is preferably in both directions around a zero position. This amount ΔL preferably lies between 0 and ±4 mm, and in particular lies between 0 and ±2.5 mm. This is accomplished by use of a non-represented drive mechanism, which is preferably arranged on the side of the cylinder 03 located opposite the rotatory drive unit.

The gear 09, 31, in particular the gear 09 of the forme cylinder 03, has at least one pair of members with normal or standard surface contact, which act positively together and which can be realized, in principle, in different ways, for example in the form of a traction gear or a planetary gear. Advantageous embodiments will be described by way of the following preferred embodiments, as depicted in FIGS. 11 to 13.

In the preferred embodiment of the present invention, in accordance with the depiction of FIG. 11, the gears 09, 31 are embodied as gears 09, 31 with coaxial axis positions, for example as epicyclic gears, such as planetary gears 09, 31 in particular which gears 09, 31 are not shown in detail, but are only shown symbolically in FIG. 11. The axes of the gears 09, 32 and the shafts of the drive motors 08, 29 are each arranged coaxially in respect to the axes of rotation of the cylinders 03, 07, 28. The compact construction by means of gears 09, 31 with coaxial axis positions, and in particular by the use of planetary gears 09, 31, makes possible an arrangement which is extremely space-saving. The large range of possible transmission or reduction gear conditions of such gears 09, 31 makes possible the use of drive motors 08, 29 of low drive output, while simultaneously assuring optimal rpm ranges. Drive motors 08, 29 of identical drive output can be employed in connection with the individually driven cylinders 03, 07, 28.

The planetary gears 09, 31 can also constitute a structural unit with the drive motors 08, 29 and can be directly connected with them.

In an advantageous embodiment each gear 09, 31 is separately encapsulated by use of a cover 34, 36, which is indicated in dashed lines in the drawings, so that dirt cannot enter into the interior, nor can lubricant, in particular thin-bodied lubricant such as oil, for example, which may possibly be present in the interior escape toward the outside from the lubricant chamber formed in this way. The individual encapsulation has great advantages, with regard to maintenance, the exchange of individual components, and the compact construction of the drive system. In connection with spur gearing in particular, which is embodied to be axially movable within itself, the encapsulation and the lubricant make possible the simultaneous low-friction operation of the gear wheel connection as well as low wear during axial movement.

In the preferred exemplary embodiment of the present invention in accordance with FIG. 12, the gears 09, 31 are embodied as gears 09, 31 with parallel axial positions, and in particular as wheel gears 09, 31 with fixed axes. A gear wheel 43, which is arranged, fixed against relative rotation, on the journal of the respective cylinder 03, 07, 28, meshes with a second gear wheel 44, for example a pinion 44, which is connected, fixed against relative rotation, with a shaft of the drive motor 08, 29. The gear 09, 31 can also have a large wheel chain or further gear elements of different types. In particular, in the case of the gear wheels 43, 44 assigned to the counter-pressure cylinder 07, 28, the gear wheels 43, 44 can also be embodied with helical teeth for increased load-carrying ability. In connection with the situation wherein, for setting the lateral register, the gear 09 and the drive motor 08 of the forme cylinder 03 are moved, besides the forme cylinder 03 itself, or that, in case of a drive motor 08 and pinion which are fixed in place on the frame, steps for correcting the circumferential register when the lateral register is moved are taken, the gear wheels 43, 44 at the forme cylinder 03 can also be embodied with helical teeth.

In a variation of the present invention, which is not specifically represented, the gears 09, 31 in accordance with the preferred embodiment in accordance with FIG. 12 can also be embodied as a positively-connected belt drive, or can have such a belt drive.

In the preferred embodiment in accordance with FIG. 13, the gears 09, 31 are embodied, as in the second preferred embodiment, as wheel gears 09, 31 with fixed shafts, but having interior teeth at the gear wheel 43 connected with the cylinder 03, 07, 28. One or a plurality of gear wheels 46, which are comparable to the planet wheels of a planetary gear but having a rotary shaft fixed in place on the frame, can be arranged between this gear wheel 43 and the pinion 44 of the drive motor 08, 29. In spite of the possibility of a large gear reduction, it is possible to embody the gear 09, 31 as a gear 09, 31 with a coaxial axis position.

In a variation of the preferred embodiment in accordance with FIG. 13, the gear wheel 46 can also be omitted. In this case, the axes of the drive motor 08, 29 and of the respective cylinder 03, 07, 28 can extend parallel, but not coaxially.

The arrangement of the drive motors 08, 29, as well as of the part of the gear 09, 39 assigned to the drive motor 08, 29, and of the gear housing, or the cover 34, 36, assigned to the drive motor 08, 29, wherein they are fixed in place on the frame, is particularly advantageous for all of the above-mentioned preferred embodiments.

In connection with an advantageous embodiment of the preferred embodiments in accordance with FIGS. 11 to 13, at least one pair of members working together as the gear 09 assigned to the forme cylinder 03 is embodied with straight teeth and makes possible a relative movement of the two members in relation to each other in the axial direction. In the preferred embodiment in accordance with FIG. 11, such a pair of members can be a sun wheel and one or a plurality of planet wheels, which are not indicated in FIG. 11. In the preferred embodiment in accordance with FIG. 12 it can be the pinion 44 and the gear wheel 43. In the preferred embodiment, in accordance with FIG. 13, it can be the gear wheel 46 and one of the gear wheels 43 or 44.

The members of the gear 09 assigned to the forme cylinder 03 which, with respect to an axial movement of the forme cylinder 03, can be moved in relation to each other, are dimensioned in such a way that in all of the positions of the forme cylinder 03, which are permitted for operation, the maximum stress of the positive connection of the members which are moved in respect to each other, for example the tooth arrangement, in respect to wear and breaking resistance is not exceeded.

For this purpose, as indicated by way of example in FIGS. 11 to 13, at least one of the tooth arrangements in the planetary gear 09, at least one of the gear wheels 43, 44 of the wheel gear 09 of the second preferred embodiment, or at least one of the gear wheels 43, 44, or possibly 46, of the wheel gear 09 in the third preferred embodiment, is embodied to be wider, in the axial direction. The width has been selected to be such that, in case of an axial displacement of the forme cylinder 03 by an amount ±ΔL, a sufficient coverage of the tooth arrangement is assured. Thus, the forme cylinder 03 can be axially moved without the drive motor 08 and a housing of the gear 09 also having to be moved.

With the exception of the preferred embodiment wherein the drive motor 08, 29 and the gear 09, 31 constitute a connected structural component, a coupling, which is not specifically represented, which cannot be shifted, but which can be disengaged, can be provided between each drive motor 08, 29 and gear 09, 31 for assembly and maintenance of the drive motor 08, 29. When arranging such structural components it is advantageous to arrange a coupling which is not specifically represented, and which cannot be shifted, but which can be disengaged, between the gear 09, 31 and the cylinders 03, 07, 28.

In a variation of the present invention, as depicted in FIGS. 7 to 10, it is possible to transfer power from the forme cylinder 03 to one or to a plurality of rollers of an inking unit 02, and also possibly to a dampening unit 06, assigned to the forme cylinder 03. This can take place, for example, via a wheel train, for example a gear wheel, which is not specifically represented, which is connected with the forme cylinder 03.

To insure as interruption-free and as feedback-free driving of the printing groups as possible, it is advantageous, as represented in FIGS. 7 to 10, if the rollers, or roller, of the inking unit 02, which is only schematically indicated, are or is individually driven, as represented, by way of example, in FIG. 12 and also for the preferred embodiments in FIGS. 11 and 13. Here, too, the individual encapsulation is of great advantage with respect to accessibility and to avoidance of possible soiling of the printing press. The same applies to the possibly provided dampening unit 06. However, inking unit and dampening unit rollers or cylinders can possibly also be driven together by one drive motor.

If a distribution cylinder 12, 21 is driven by the drive motor 17, 24 via the gear 16, 23, this drive should be embodied, in an advantageous manner, according to that of the forme cylinder 03, so that an axial traversing movement of the distribution cylinder occurs without effect on the position of the cylinder in the circumferential direction.

Figure 14:
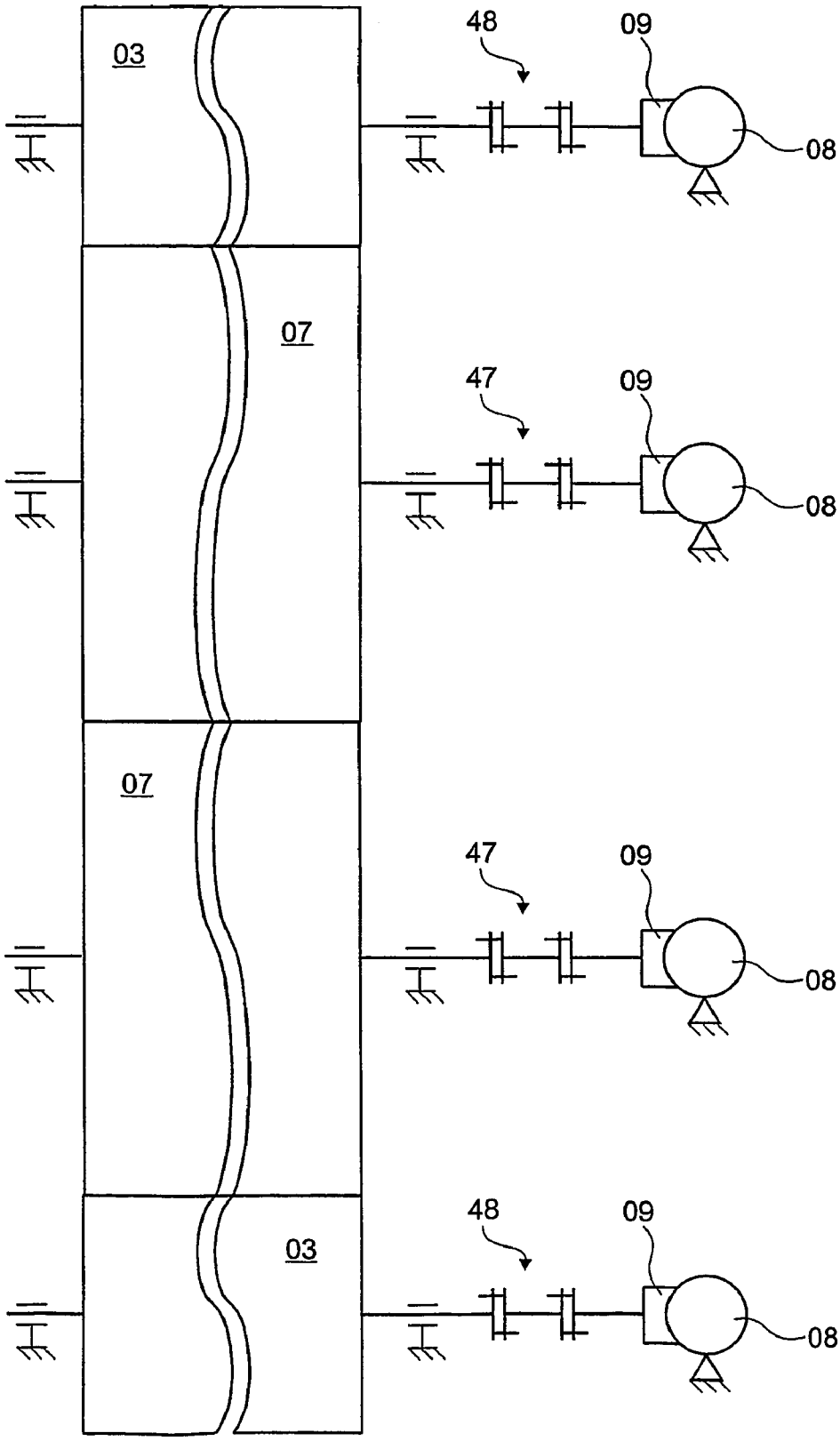

In an advantageous embodiment, it is possible, as depicted in FIG. 14, in case of a drive motor 08 fixed in place on the frame, to arrange a coupling 47, which coupling 47 compensates for angles and offsets, at the transfer cylinder 07 between the transfer cylinder 07 and the drive motor 08, in order to compensate for the engagement and disengagement movement of the transfer cylinder 07. Coupling 47 can be embodied as a double joint or, in an advantageous embodiment, as an all-metal coupling 47 with two torsionally rigid, but axially deformable multi-disk packets. The all-metal coupling 47 can simultaneously compensate for the offset and the linear change caused by this engagement and disengagement movement of the transfer cylinder 07. It is essential that the rotatory movement of transfer cylinder 07 be transmitted free of play.

For the situation of the coaxial driving of the forme cylinder 03 by the use of a drive motor 08 fixed in place on the frame, the drive unit of the forme cylinder 03 can have a coupling 48 between the journal and the drive motor 08 which coupling 48, for adjusting the lateral register, absorbs at least an axial relative movement between the cylinder 03 and the drive motor 08. In order to also absorb manufacturing tolerances and also possibly required movements of the forme cylinder 03 for adjustment purposes, the coupling 48 is embodied as a coupling 48 which absorbs at least slight angles and offset. In an advantageous embodiment, coupling 48 is also designed as an all-metal coupling 48 with two torsionally rigid, but axially deformable multi-disk packets. The linear movement is absorbed by the multi-disk packets, which are positively connected in the axial direction with the journal of the forme cylinder 03, or with a shaft at the output from the gear 09 or the drive motor 08.

In contrast to printing presses with double circumference and single width, the embodiment of the cylinders 03, 07, with double width, and at least the forme cylinders 03 with a "single circumference" makes a considerably greater product variability possible. Although the maximum number of possible printed pages remains the same, in the case of single-width printing groups with double circumference they are in two different "books", or "booklets" in the collection operation. In the present case, with double-width printing groups of single circumference, the double-width webs 04 are longitudinally cut after having been imprinted. In order to achieve a maximum booklet width, one or several partial webs are conducted one above the other in the so-called folding superstructure, or the turning deck, and are folded to form a booklet, for example on a former without collection operations. If such booklet thicknesses are not required, some partial webs can be guided on top of each other, but others can be conducted together to a second former and/or folding apparatus. However, two products of identical thickness can also be conducted to two folding apparatus without being transferred. A variable thickness of two different products is thus provided. If, in case of a double folding apparatus or of two folding apparatus, at least two product delivery devices are provided. It is possible, depending on the arrangement, to conduct the two booklets, or products, next to or above each other to one side of the printing press, or to two different sides of the press.

The double-width printing press of single circumference has a great variability, in particular when staggering the possible page numbers of the product, the co-called "page jump". While the thickness per booklet, or layer, in the printing press of double circumference and single width can only be varied in steps of four printed pages during collection operations, i.e. with maximum product thickness, the described double-width printing press of single circumference allows a "page jump" of two pages, for example when printing newspapers. The product thickness, and in particular the "distribution" of the printed pages to different booklets of the total product or the products, is considerably more flexible.

After the web 04 has been longitudinally cut, the partial web is conducted either to a former and/or to a folding apparatus, which is different in respect to the corresponding partial web, or which is turned to be aligned with the last mentioned one. This means that in the second case, the partial web is brought into the correct linear, or cutting register prior to, during or after turning, but before being brought together with the "straight ahead webs". In an advantageous embodiment, this is taken into account by the appropriate design of the turning deck, for example by the preset distances between the bars, or of the path sections. Fine adjustment, or correction, can be performed by use of the actuating paths of the cutting register control device of the affected partial web and/or of the partial web strand. If several grooves should be arranged on the forme cylinder side-by-side in the linear direction, but offset from each other in the circumferential direction, this offset in the printed image must be taken into consideration in the above mentioned embodiment of the distances between the turning bars in order to place partial webs on two different running levels on top of each other with the correct registration. A fine adjustment can then be again performed by use of the cutting register regulation.

Figure 15:
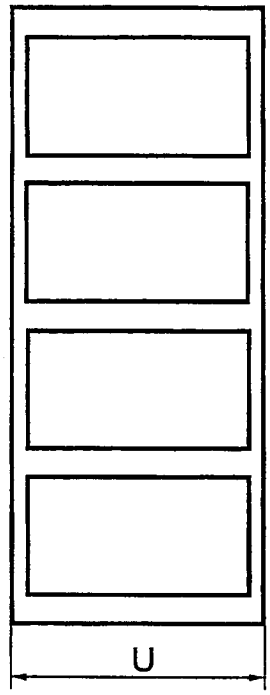
Figure 16:
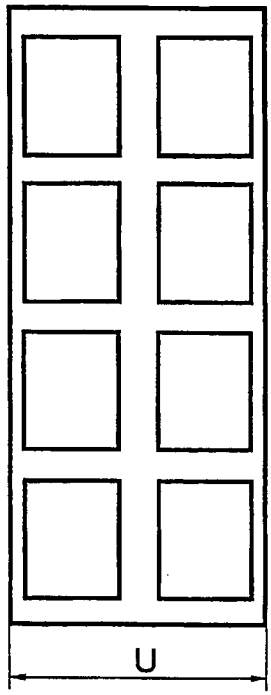
Figure 17:
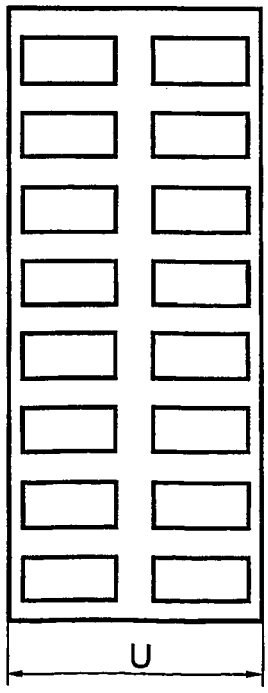
Figure 18:
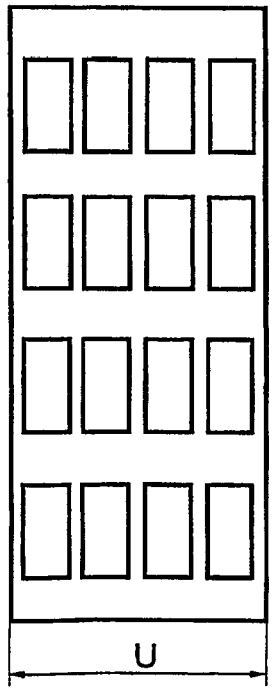

Now, the forme cylinder 03 can be provided, in the circumferential direction, with one vertical printed page, and in the linear direction with at least four printed pages in broadsheet format, as seen in FIG. 15. Alternatively, this forme cylinder 03 can also be selectively provided with two pages in the circumferential direction and, in the linear direction with at least four horizontal printed pages in tabloid format, as seen in FIG. 16, or with two pages in the circumferential direction and, in the linear direction with at least eight vertical printed pages in book format, as seen in FIG. 17, or with four pages in the circumferential direction and in the linear direction with at least four horizontal printed pages in book format, as seen in FIG. 18 by the use of respectively one flexible printing plate which can be arranged in the circumferential direction of the forme cylinder 03, and at least one flexible printing plate arranged in the linear direction of the forme cylinder 03.

Thus, depending on the placement on the forme cylinders 03 with horizontal tabloid pages, or with vertical newspaper pages, and in particular with broadsheet pages, with horizontal or vertical book pages, it is possible by use of the double-width printing press and at least the forme cylinders 03 of single circumference to produce different products, depending on the width of the web 04 used.

Thus, with the double printing group 13, the production, in one stage, of two vertical printed pages arranged on the forme cylinder, a "two page jump", with variable products in broadsheet format, is possible.

With a width of the web 04 corresponding to four, or to three, or to two vertical printed pages, or of one printed page in broadsheet format, the production of a product in broadsheet format consisting of a layer in the above sequence with eight, or six, or four, or two printed pages is possible.

With a web width corresponding to four vertical printed pages in broadsheet format, the double printing group can be used for producing respectively two products in broadsheet format, consisting of one layer with four printed pages in the one product and with four printed pages in the other product, or with two printed pages in the one product and with six printed pages in the other product. With a web width corresponding to three vertical printed pages, the double printing group is suitable for producing respectively two products in broadsheet format consisting of one layer with four printed pages in the one product and of two printed pages in the other product.

Furthermore, with a web width corresponding to four vertical printed pages in broadsheet format, the double printing group can be used for the production of a product, in broadsheet format, consisting of two layers with four printed pages in the one layer and with four printed pages in the other layer, or with two printed pages in the one layer and with six printed pages in the other layer. With a web width corresponding to three vertical printed pages, the double printing group can be used for producing a product, in broadsheet format, consisting of two layers with four printed pages in the one layer and with two printed pages in the other layer.

In the case of printed pages in tabloid format, the double printing group can be used for producing, in one stage, printed pages arranged horizontally on the forme cylinder 03 with variable products, such as a "four page jump", in tabloid format. Accordingly, with a web width corresponding to four, or to three, or to two horizontal printed pages, or to one horizontal page, the double printing group can be used for producing a product, in tabloid format, consisting of one layer in the above sequence with sixteen, or with twelve, or with eight, or with four printed pages.

With a web width corresponding to four horizontal printed pages in tabloid format, the double printing group can be used for producing two products in tabloid format, each consisting of one layer with eight printed pages in the one product and with eight printed pages in the other product, or with four printed pages in the one product and with twelve printed pages in the other product. With a web width corresponding to three horizontal printed pages, the double printing group can be used for producing two products in tabloid format, each consisting of one layer with four printed pages in the one product and with eight printed pages in the other product.

With products in book format, the double printing group can be used for producing, in one stage, eight printed pages with variable, such as "eight page jump", products arranged vertically on the forme cylinder.

With a web width corresponding to eight, or to six, or to four, or to two vertical printed pages, the production of a product in book format consisting of a layer in the above sequence with thirty-two, or twenty-four, or sixteen, or eight printed pages, is possible by use of the double printing group.

With a web width corresponding to eight vertical printed pages in book format, the double printing group can be used for producing respectively two products in book format, each product consisting of one layer, with sixteen printed pages in the one product and with sixteen printed pages in the other product, or with twenty-four printed pages in the one product and with eight printed pages in the other product. With a web width corresponding to six vertical printed pages in book format, the double printing group can be used for producing respectively two products in book format, each product consisting of one layer, with sixteen printed pages in the one product and with eight printed pages in the other product.

The double printing group is furthermore usable for producing, in one stage, eight printed pages arranged vertically with variable products, i.e. an "eight page jump" on the forme cylinder, with a double transverse fold.

With a web width corresponding to four, or to three, or to two horizontal printed products, or to one horizontal printed page in book format, the double printing group can be used for producing a product in book format consisting of a layer in the above sequence with thirty-two, or with twenty-four, or with sixteen, or with eight printed pages.

With a web width corresponding to four horizontal printed pages in book format, the double printing group can be used for producing respectively two products in book format, each product consisting of a layer, with sixteen printed pages in the one product and with sixteen printed pages in the other product, or with twenty-four printed pages in the one product and with eight printed pages in the other product. With a web width corresponding to three horizontal printed pages in book format, the double printing group can be used for producing respectively two products in book format, each product consisting of a layer, with sixteen printed pages in the one product and with eight printed pages in the other product.

If the two partial web strands are longitudinally folded on different formers and thereafter are conducted to a common folding apparatus, what was said above should be applied to the distribution of the products to different folded booklets, or layers, of the described variable number of pages.

While preferred embodiments of printing groups of a printing press, in accordance with the present invention, have been set forth fully and completely hereinabove, it will be apparent to one of skill in the art that various changes in, for example, the specific type of web being printed, the specific structure of the drive motors, and the like could be made without departing from the true spirit and scope of the subject invention which is accordingly to be limited only by the appended claims.

What is claimed is:

1. A printing group comprising:

at least one pair of cylinders including a forme cylinder and a transfer cylinder;

an impression cylinder cooperating with said transfer cylinder for applying ink from said transfer cylinder to a web to be printed as the web passes between said impression cylinder and said transfer cylinder;

a forme cylinder circumference, a transfer cylinder circumference and an impression cylinder circumference, said circumference of at least one of said transfer cylinder and said impression cylinder being a whole number multiple greater than one of said forme cylinder circumference;

a forme cylinder drive motor;

a transfer cylinder drive motor, said transfer cylinder drive motor and said forme cylinder drive motor being mechanically independent of each other;

an inking unit assigned to said forme cylinder;

an inking unit rotary drive motor, said inking unit rotary drive motor being mechanically independent of said forme cylinder and said forme cylinder drive motor; and an encapsulated gear between said inking unit and said inking unit rotary drive motor.

2. The printing group of claim 1 further including a gear between each said forme cylinder and said forme cylinder drive motor and said transfer cylinder and said transfer cylinder drive motor.

3. The printing group of claim 1 further including an angle and offset compensating coupling between said transfer cylinder and said transfer cylinder drive motor.

4. The printing group of claim 1 further including an axial movement compensating coupling between said forme cylinder and said forme cylinder drive motor.

5. The printing group of claim 1 wherein each said drive motor is fixed in place on a frame of said printing group.

6. The printing group of claim 1 further including a second pair of cylinders including a second forme cylinder and a second transfer cylinder, said second transfer cylinder forming said impression cylinder, said one pair of cylinders and said second pair of cylinders cooperating to form a double printing group.

7. The printing group of claim 6 further including a second forme cylinder drive motor and a second transfer cylinder drive motor, each of said second drive motors being mechanically independent.

8. The printing group of claim 6 further including a common drive motor for said second forme cylinder and said second transfer cylinder, said common drive motor being mechanically independent.

9. The printing group of claim 6 further using said double printing group for producing two vertical pages arranged on said forme cylinder with variable products in broadsheet format.

10. The printing group of claim 1 wherein said impression cylinder is a counter-pressure cylinder and applies ink to one side of the web passing between said impression cylinder and said transfer cylinder.

11. The printing group of claim 10 wherein said impression cylinder is twice said forme cylinder circumference.

12. The printing group of claim 1 further including additional cylinder pairs each including a forme cylinder and a transfer cylinder and wherein said impression cylinder is a satellite cylinder cooperating with said transfer cylinders of said one cylinder pair and said additional cylinder pairs.

13. The printing group of claim 12 wherein said satellite cylinder circumference is twice said forme cylinder circumference.

14. The printing group of claim 1 wherein said transfer cylinder circumference is twice said forme cylinder circumference.

15. The printing group of claim 1 further including a printing plate end receiving slit in said circumference of said forme cylinder.

16. The printing group of claim 1 including a support plate secured to said transfer cylinder, said support plate including a rubber blanket, and including beveled ends on said support plate, and further including a slit in said transfer cylinder circumference, said slit extending in a linear direction and receiving said beveled ends and securing them against sliding out of said slit.

17. The printing group of claim 16 further including a plurality of said slits offset to each other in said circumferential direction.

18. The printing group of claim 1 further including a groove in said transfer cylinder circumference, and further including a rubber blanket having ends, said ends being received in said groove.

19. The printing group of claim 18 further including a plurality of said grooves offset to each other in said circumferential direction.

20. The printing group of claim 1 further including at least one releasable bearing support for said transfer cylinder.

21. The printing group of claim 1 further including one circumferential printing plate and four linear vertical plates in broadsheet format on said forme cylinder.

22. The printing group of claim 21 further including selectively one of two circumferential and four horizontal linear printed pages in tabloid format; two circumferential and eight vertical linear pages in book format; four circumferential and four linear printed pages in book format on one printing plate arranged in the circumferential direction of said forme cylinder and in its linear direction with at least one said printing plate.

23. The printing group of claim 1 wherein said web passes between said impression cylinder and said transfer cylinder in a vertical direction.

24. The printing group of claim 1 wherein said encapsulated gear includes a closed gear housing with a lubricant in said housing.

25. The printing group of claim 24 further including first and second lateral frame walls for said printing group, said first lateral frame wall forming a portion of said closed gear housing.

26. The printing group of claim 25 wherein said inking unit drive motor is secured to said first lateral frame wall, and further including an inking unit axial drive motor on said second lateral frame wall.

27. A printing group comprising:

at least one pair of cylinders including a forme cylinder and a transfer cylinder;

an impression cylinder cooperating with said transfer cylinder for applying ink from said transfer cylinder to a web to be printed as the web passes between said impression cylinder and said transfer cylinder;

a forme cylinder circumference, a transfer cylinder circumference and an impression cylinder circumference, said circumference of at least one of said transfer cylinder and said impression cylinder being a whole number multiple greater than one of said forme cylinder circumference;

an impression cylinder drive motor;

a drive unit for said at least one pair of cylinders, said impression cylinder drive motor being mechanically independent of said drive unit;

an inking unit assigned to said forme cylinder;

an inking unit rotary dirve motor, said inking unit rotary drive motor being mechanically independent of said at least one pair of cylinders and said drive unit; and an encapsulated gear between said inking unit and said inking unit rotary drive motor.

28. The printing group of claim 27 further including a forme cylinder drive motor and a transfer cylinder drive motor in said drive unit, each of said drive motors being mechanically independent of the other.

29. The printing group of claim 28 further including an angle and offset compensating coupling between said transfer cylinder and said transfer cylinder drive motor.

30. The printing group of claim 28 further including an axial movement compensating coupling between said forme cylinder and said forme cylinder drive motor.

31. The printing group of claim 28 wherein each said drive motor is fixed in place on a frame of said printing group.

32. The printing group of claim 27 further including a common drive motor for said transfer cylinder and said forme cylinder located at said forme cylinder and which is mechanically independent.

33. The printing group of claim 32 further including an axial movement compensating coupling between said forme cylinder and said forme cylinder drive motor.

34. The printing group of claim 32 wherein each said drive motor is fixed in place on a frame of said printing group.

35. The printing group of claim 27 further including a common drive motor for said transfer cylinder and said forme cylinder located at said transfer cylinder and which is mechanically independent.

36. The printing group of claim 35 further including an angle and offset compensating coupling between said transfer cylinder and said transfer cylinder drive motor.

37. The printing group of claim 35 wherein each said drive motor is fixed in place on a frame of said printing group.

38. The printing group of claim 27 wherein said impression cylinder is a counter-pressure cylinder and applies ink to one side of the web passing between said impression cylinder and said transfer cylinder.

39. The printing group of claim 38 wherein said impression cylinder circumference is twice said forme cylinder circumference.

40. The printing group of claim 27 further including additional cylinder pairs each including a forme cylinder and a transfer cylinder and wherein said impression cylinder is a satellite cylinder cooperating with said transfer cylinders of said one cylinder pair and said additional cylinder pairs.

41. The printing group of claim 40 wherein said satellite cylinder circumference is twice said forme cylinder circumference.

42. The printing group of claim 27 wherein said transfer cylinder circumference is twice said forme cylinder circumference.

43. The printing group of claim 27 further including a printing plate end receiving slit in said circumference of said forme cylinder.

44. The printing group of claim 27 including a support plate secured to said transfer cylinder, said support plate including a rubber blanket, and including beveled ends on said support plate, and further including a slit in said transfer cylinder circumference, said slit extending in a linear direction and receiving said beveled ends and securing them against sliding out of said slit.

45. The printing group of claim 44 further including a plurality of said slits offset to each other in said circumferential direction.

46. The printing group of claim 27 further including a groove in said transfer cylinder circumference, and further including a rubber blanket having ends, said ends being received in said groove.

47. The printing group of claim 46 further including a plurality of said grooves offset to each other in said circumferential direction.

48. The printing group of claim 27 further including one circumferential printing plate and four linear vertical plates in broadsheet format on said forme cylinder.

49. The printing group of claim 48 further including selectively one of two circumferential and four horizontal linear printed pages in tabloid format; two circumferential and eight vertical linear pages in book format; four circumferential and four linear printed pages in book format on one printing plate arranged in the circumferential direction of said forme cylinder and in its linear direction with at least one said printing plate.

50. The printing group of claim 27 wherein said web passes between said impression cylinder and said transfer cylinder in a vertical direction.

51. The printing group of claim 27 wherein said encapsulated gear includes a closed gear housing with a lubricant in said housing.

52. The printing group of claim 51 further including first and second lateral frame walls for said printing group, said first lateral frame wall forming a portion of said closed gear housing.

53. The printing group of claim 52 wherein said inking unit drive motor is secured to said first lateral frame wall, and further including an inking unit axial drive motor on said second lateral frame wall.

* * * * *